US011487236B2

(12) United States Patent
Sakai et al.

(10) Patent No.: US 11,487,236 B2
(45) Date of Patent: Nov. 1, 2022

(54) RECOVERY CONTAINER AND POWDER COATING DEVICE

(71) Applicant: FUJIFILM Business Innovation Corp., Tokyo (JP)

(72) Inventors: Yusuke Sakai, Ebina (JP); Lei Yuan, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/375,439

(22) Filed: Jul. 14, 2021

(65) Prior Publication Data

US 2022/0308521 A1 Sep. 29, 2022

(30) Foreign Application Priority Data

Mar. 26, 2021 (JP) ..... JP2021-053822

(51) Int. Cl.
*G03G 21/12* (2006.01)
*G03G 15/08* (2006.01)
*G03G 21/18* (2006.01)

(52) U.S. Cl.
CPC ..... *G03G 21/12* (2013.01); *G03G 15/0822* (2013.01); *G03G 15/0865* (2013.01); *G03G 21/1821* (2013.01)

(58) Field of Classification Search
CPC .. G03G 21/105; G03G 21/12; G03G 15/0822; G03G 15/0865; G03G 15/0886;
(Continued)

(56) References Cited

U.S. PATENT DOCUMENTS

2007/0297840 A1 12/2007 Onodera
2014/0086642 A1* 3/2014 Itabashi ..... G03G 15/0865 399/284

(Continued)

FOREIGN PATENT DOCUMENTS

EP 3 521 943 A1 8/2019
JP 3743282 B2 2/2006

(Continued)

OTHER PUBLICATIONS

Extended European Search Report dated Jan. 21, 2022, issued by the European Patent Office in counterpart European Patent Application No. 21189832.5.

*Primary Examiner* — Jessica L Eley
(74) *Attorney, Agent, or Firm* — Sughrue Mion, PLLC

(57) ABSTRACT

A recovery container includes: a container body that is attachable to and detachable from an attachment target and capable of accommodating a powder; a first insertion portion that is provided at the container body, is capable of protruding from one of two wall portions of the container body at opposite sides in a direction intersecting an attachment direction of the container body, and is to be inserted into a first opening provided in a portion of the attachment target facing the one of the two wall portions by movement in a protruding direction of the first insertion portion; a second insertion portion that is provided at the container body, is capable of protruding from other of the two wall portions to a side opposite to the first insertion portion, and is to be inserted into a second opening provided in a portion of the attachment target facing the other of the two wall portions by movement in a protruding direction of the second insertion portion; and a third insertion portion that is provided at the container body, is capable of protruding from the other of the two wall portions to a side same as the second insertion portion, and is to be inserted into a third opening provided (Continued)

in a portion of the attachment target facing the other of the two wall portions by movement in a protruding direction of the third insertion portion.

20 Claims, 19 Drawing Sheets

(58) Field of Classification Search
CPC ..... G03G 15/0877; G03G 15/0872; G03G 15/0879; G03G 15/0855
See application file for complete search history.

(56) References Cited

U.S. PATENT DOCUMENTS

2017/0285568 A1 10/2017 Nishiyama et al.
2020/0096932 A1* 3/2020 Kobayashi ..... G03G 15/0865

FOREIGN PATENT DOCUMENTS

JP 6551093 B2 7/2019
WO WO-2019009367 A1 * 1/2019 ..... F16B 17/00

* cited by examiner

RECOVERY CONTAINER AND POWDER COATING DEVICE

CROSS-REFERENCE TO RELATED APPLICATIONS

This application is based on and claims priority under 35 USC 119 from Japanese Patent Application No. 2021-053822 filed on Mar. 26, 2021.

BACKGROUND

1. Technical Field

The present disclosure relates to a recovery container and a powder coating device.

2. Related Art

Japanese Patent No. 6551093 discloses a powder recovery container that is to be detachably attached to an image forming device.

SUMMARY

There is a powder recovery container to be attached to an attachment target. In the recovery container, a pair of insertion portions that protrude (move in a protruding direction) in directions mutually opposite to each other in a direction intersecting an attachment direction is provided, and the recovery container is attached to the attachment target by inserting the pair of insertion portions into a corresponding opening of the attachment target. However, an attachment posture of the attached recovery container may not be stable.

Aspects of non-limiting embodiments of the present disclosure relate to stabilizing an attachment posture of a container body as compared with a configuration in which the attachment posture of the container body is kept only by a pair of insertion portions protruding in directions mutually opposite to each other in a direction intersecting an attachment direction.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a recovery container including: a container body that is attachable to and detachable from an attachment target and capable of accommodating a powder; a first insertion portion that is provided at the container body, is capable of protruding from ore of two wall portions of the container body at opposite sides in a direction intersecting an attachment direction of the container body, and is to be inserted into a first opening provided in a portion of the attachment target facing the one of the two wall portions by movement in a protruding direction of the first insertion portion; a second insertion portion that is provided at the container body, is capable of protruding from other of the two wall portions to a side opposite to the first insertion portion, and is to be inserted into a second opening provided in a portion of the attachment target facing the other of the two wall portions by movement in a protruding direction of the second insertion portion; and a third insertion portion that is provided at the container body, is capable of protruding from the other of the two wall portions to a side same as the second insertion portion, and is to be inserted into a third opening provided in a portion of the attachment target facing the other of the two wall portions by movement in a protruding direction of the third insertion portion.

BRIEF DESCRIPTION OF THE DRAWINGS

Exemplary embodiment(s) of the present invention will be described in detail based on the following figures, wherein.

DETAILED DESCRIPTION

A recovery container and a powder coating device according to an exemplary embodiment of the present disclosure will be described.

First, an image forming device 10, which is an example of a powder coating device according to the exemplary embodiment, will be described, and then a recovery container 60 used in the image forming device 10 will be described.

[Overall Configuration]

First, the image forming device 10 according to the present exemplary embodiment will be described.

Figure 1:
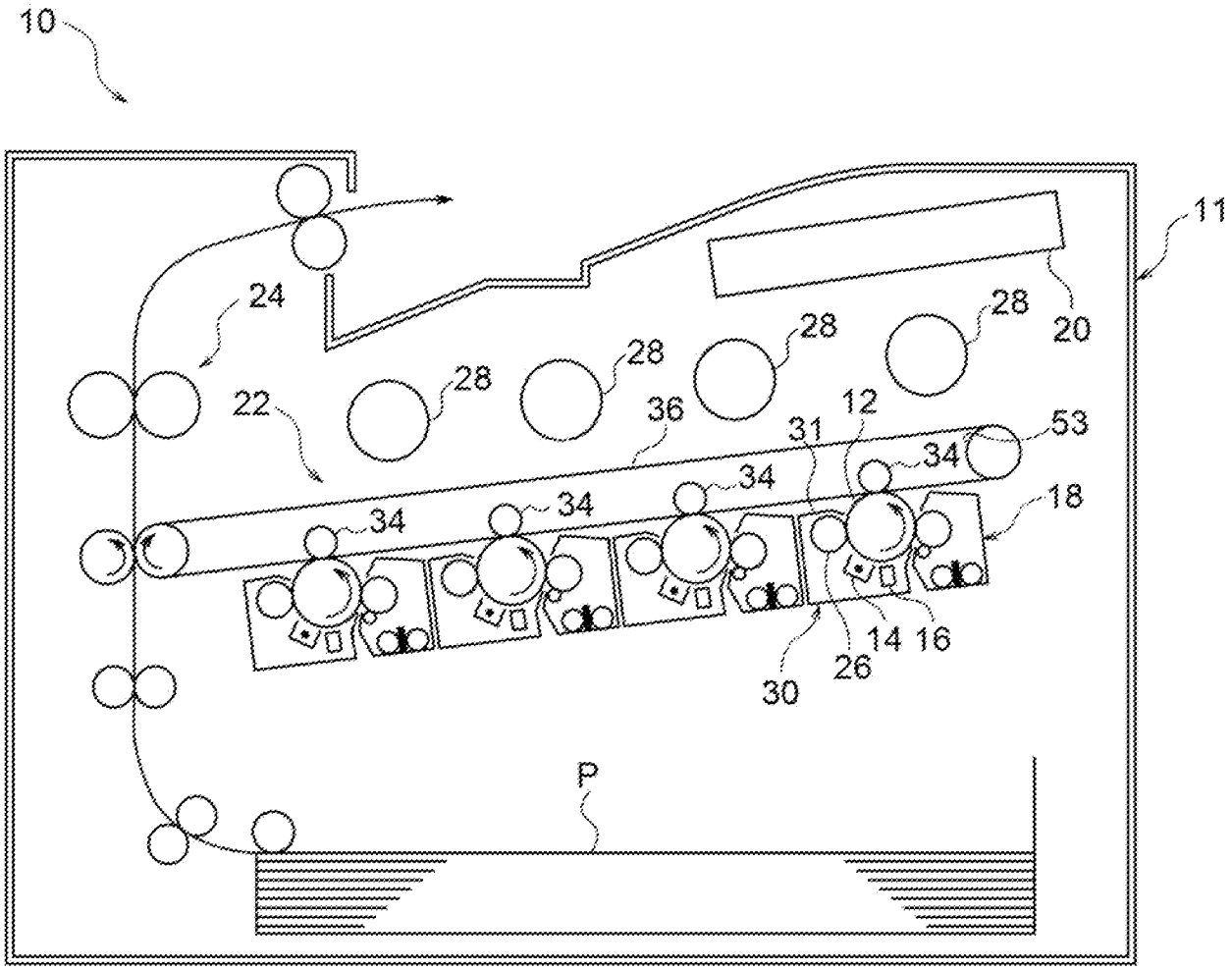
FIG. 1 is a schematic configuration diagram of an image forming device according to an exemplary embodiment of the present disclosure.
Figure 1:
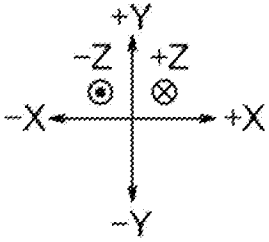
Figure 2:
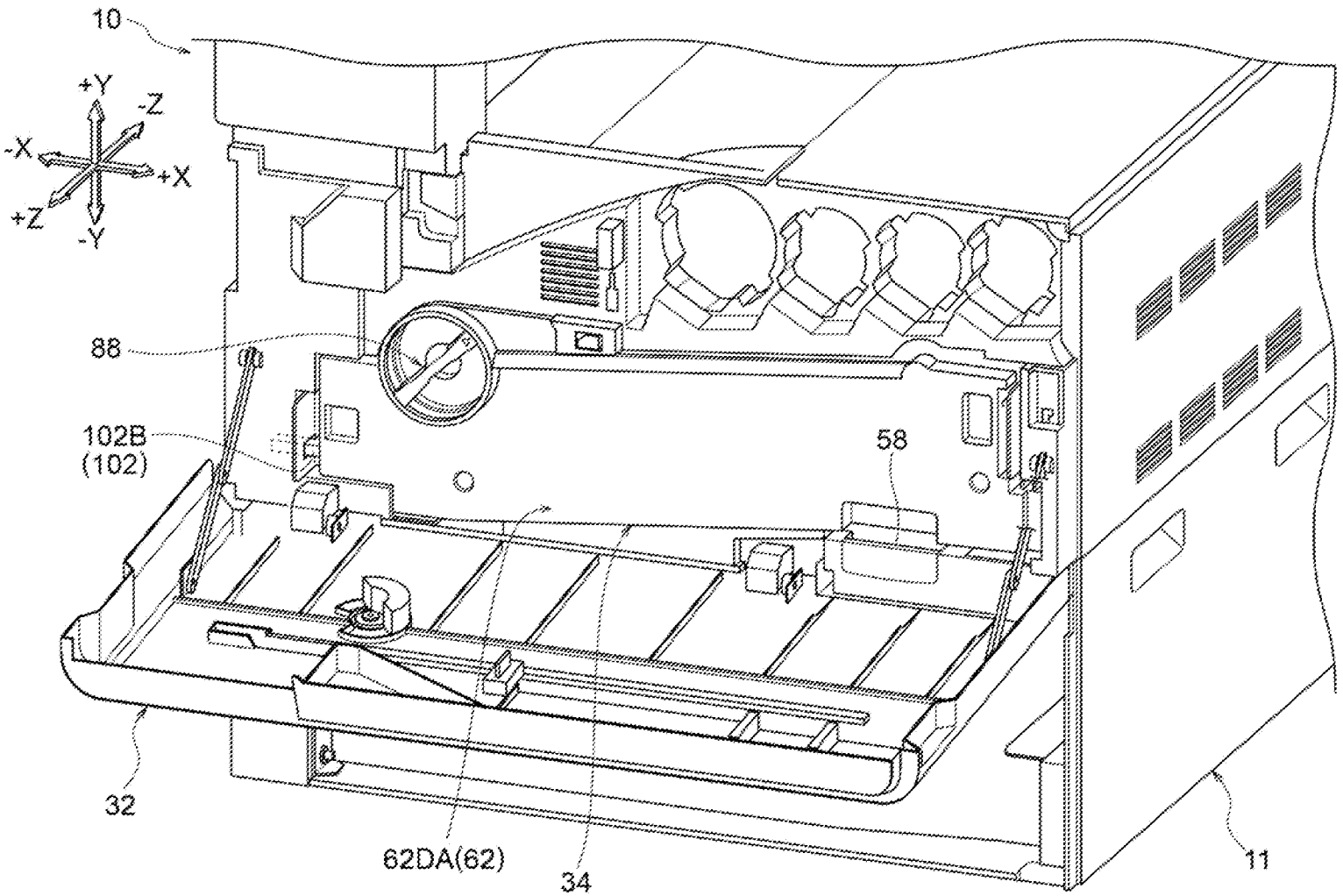
FIG. 2 is a perspective view of an image forming device according to the exemplary embodiment of the present disclosure, illustrating a state where a cover is opened.

As illustrated in FIGS. 1 and 2, the image forming device 10 includes a housing 11 serving as a device body. As illustrated in FIG. 1, in the housing 11, the image forming device 10 includes a photoconductor 12 serving as an example of an image carrier, a charging device 14 serving as an example of a charger, an exposure device 16 serving as an example of an exposure unit, a developing device 18 serving as an example of a supply unit, a controller 20 serving as an example of a controller, a transfer device 22 serving as an example of a transfer unit, a fixing device 24 serving as an example of a fixing unit, a cleaning device 26 serving as an example of a cleaner, and a toner cartridge 28 serving as an example of a powder container. The photoconductor 12, the charging device 14, the exposure device 16, and the cleaning device 26 form a photoconductor unit 30 serving as an example of an image holding unit. A housing 31 of the photoconductor unit 30 is detachably attached to the housing 11.

When the image forming device 10 is viewed from a side on which a user (not shown) stands, a device width direction, a device height direction, and a device depth direction are referred to as an X direction, a Y direction, and a Z direction, respectively in the following description. The X direction, the Y direction, and the Z direction are orthogonal to one another. In addition, when it is necessary to distinguish one side and the other side in each of the X direction, the Y direction, and the Z direction, in a front view of the image forming device 10, an upper side of the image forming device 10 is described as a +Y side, a lower side thereof is described as a −Y side, a right side thereof is described as a +X side, a left side thereof is described as a −X side, a back side thereof is described as a +Z side, and a front side thereof is described as a −Z direction. The Y direction is an example of a gravity direction. The X direction and the Z direction are examples of a horizontal direction.

As illustrated in FIG. 2, a cover 32 that rotates toward a front side in the device depth direction is attached to a front surface of the housing 11. On aback side of the cover 32 in the device depth direction, a recovery container 60 for a developer, which is an example of a powder and serves as a colorant, is detachably attached to the housing 11 that is an example of an attachment target. Specifically, the housing 11 is formed with an accommodating portion 50 having a shape corresponding to an outer shape of the recovery container 60, and the recovery container 60 is accommodated in the accommodating portion 50 so as to be attached to the housing 11. A width direction, a height direction, and a thickness direction of the recovery container 60 coincide with the device width direction, the device height direction, and the device depth direction in a state where the recovery container 60 is attached to the housing 11. Therefore, when the recovery container 60 is viewed from the front, an upper side of the recovery container 60 corresponds to the +Y side, a lower side thereof corresponds to the −Y side, a right side thereof corresponds to the +X side, a left side thereof corresponds to the −X side, a back side thereof corresponds to the +Z side, and a front side thereof corresponds to the −Z side.

Figure 11:
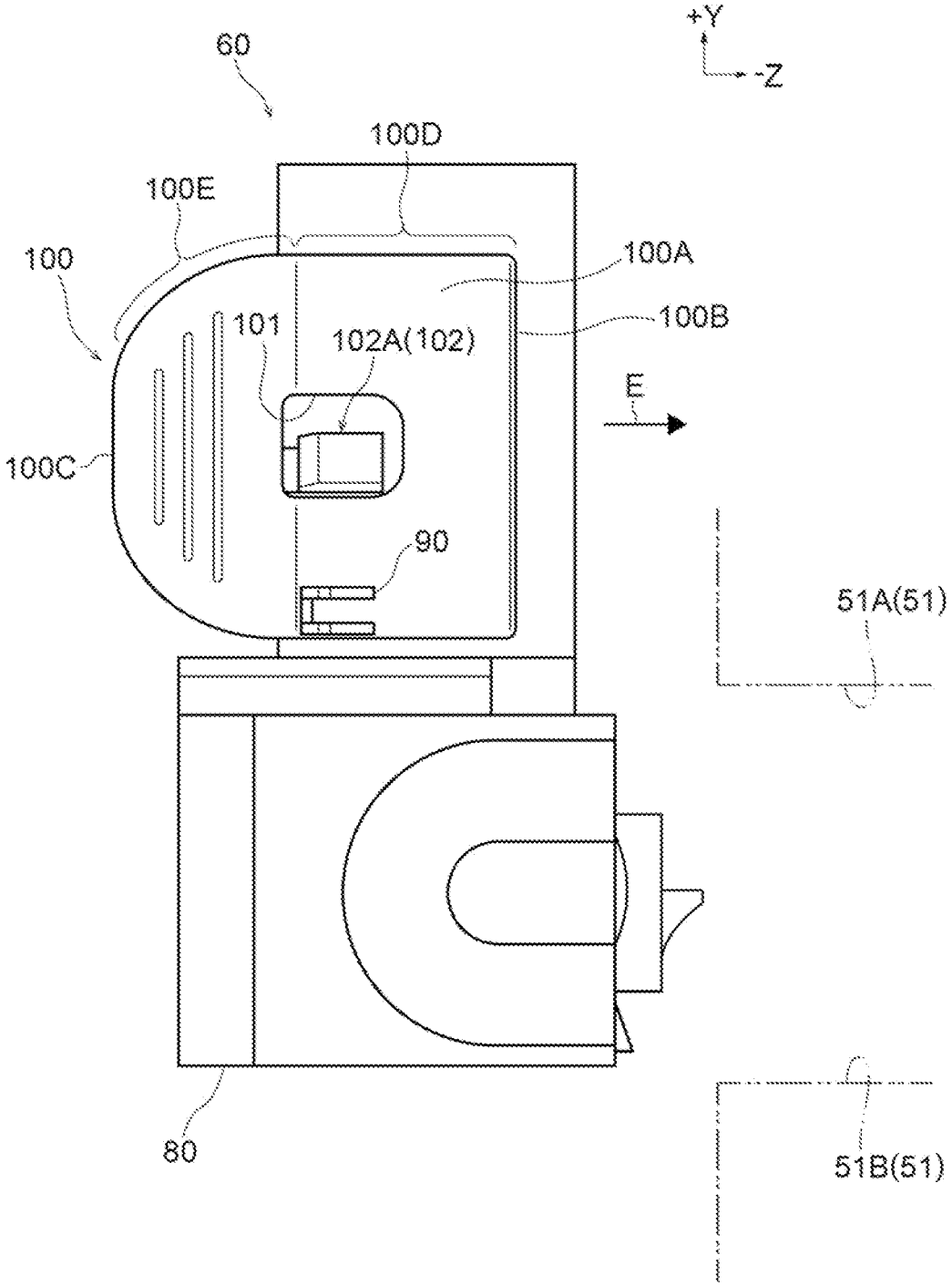
FIG. 11 is a side view of the side portion on one side in the width direction of the recovery container of FIG. 9, as viewed from a lateral side.

In FIG. 11, an attachment direction of the recovery container 60 (container body 62) with respect to the housing 11 is indicated by an arrow E direction. Note that the attachment direction referred to here is the same direction as the back side in the device depth direction.

Figure 3:
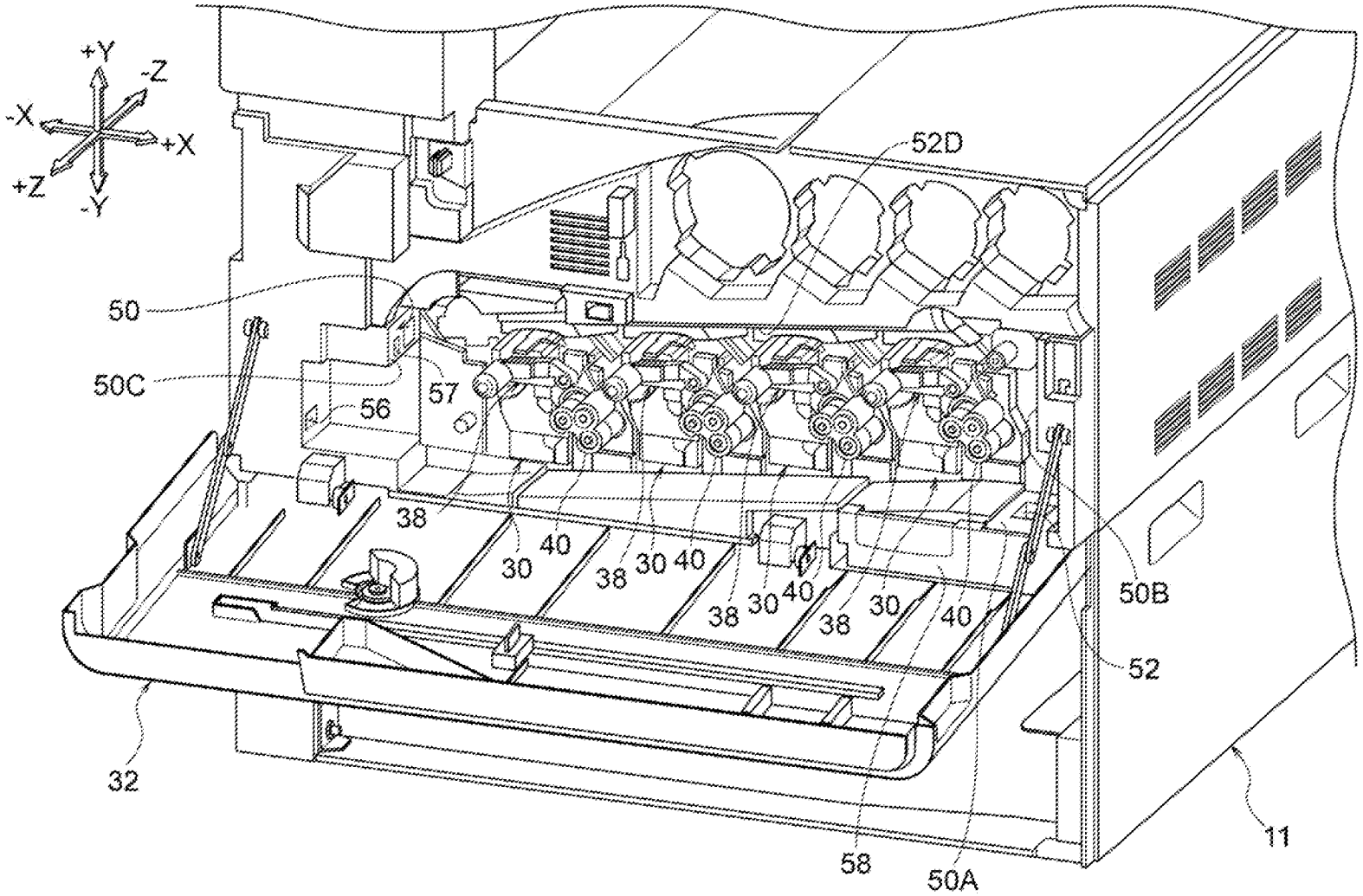
FIG. 3 is a perspective view of the image forming device of FIG. 2, illustrating a state where a recovery container is removed.
Figure 4:
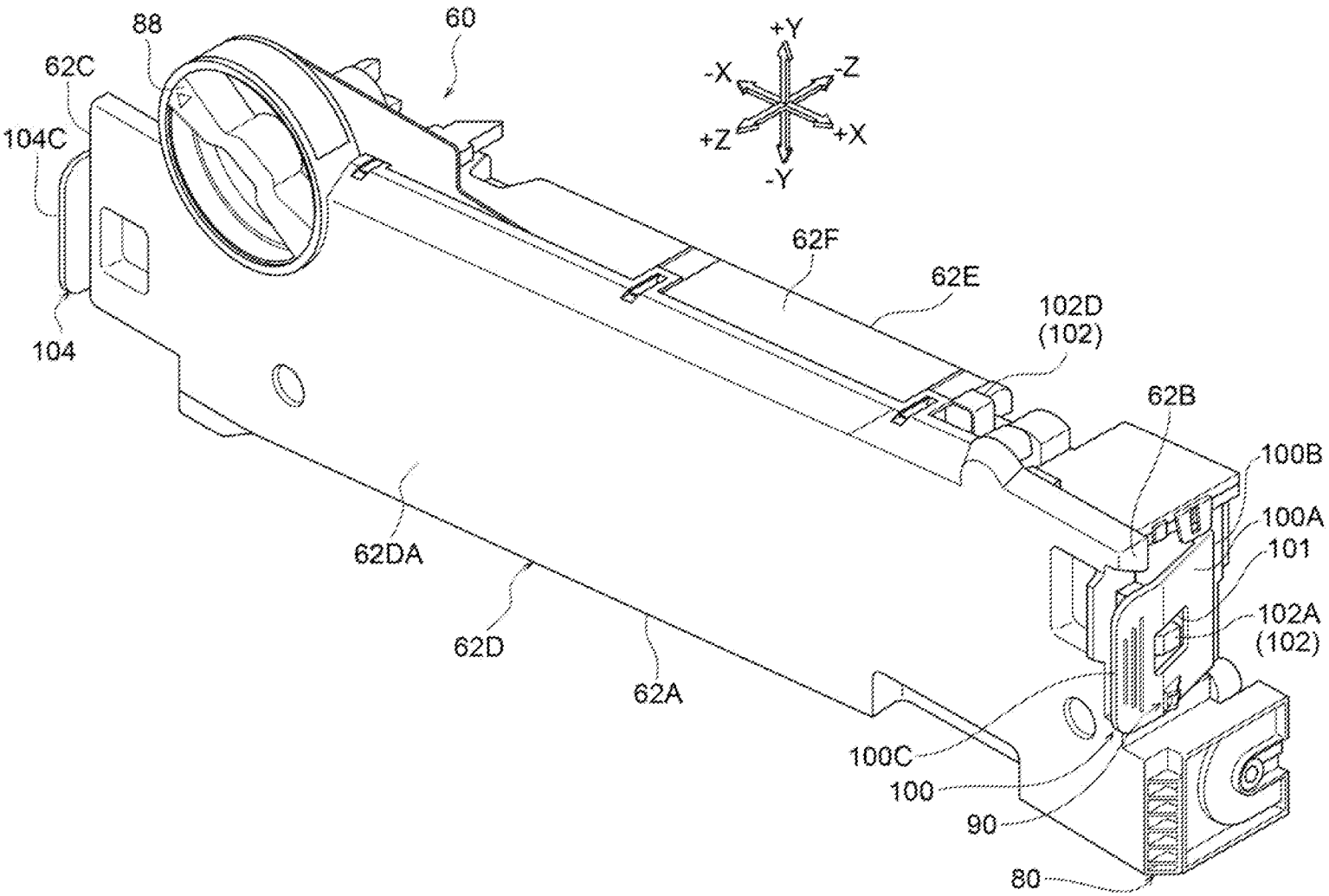
FIG. 4 is a perspective view of the recovery container of FIG. 2 as viewed from a front side, illustrating a state where the recovery container is unlocked from a housing (a state where locking is released)
Figure 7:
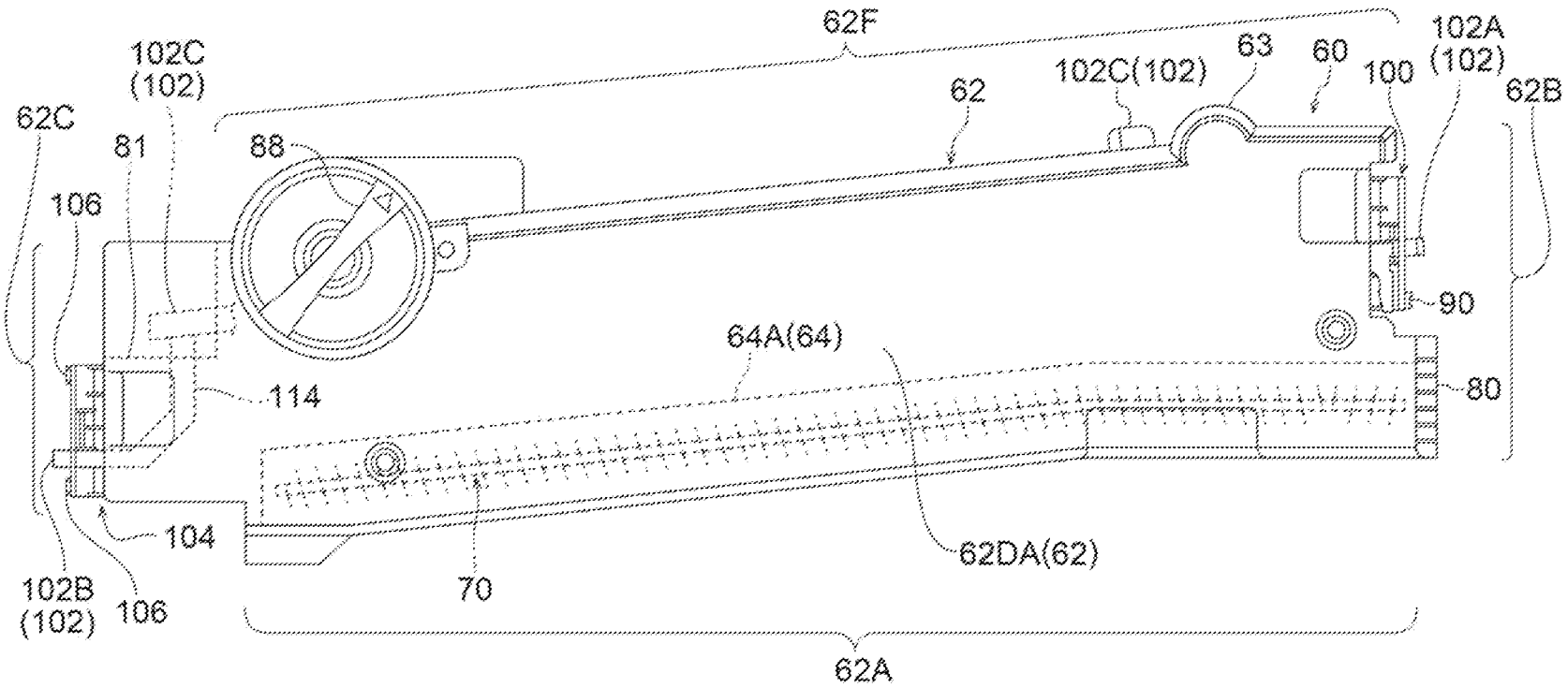
FIG. 7 is a front view of the recovery container of FIG. 5.
Figure 8:
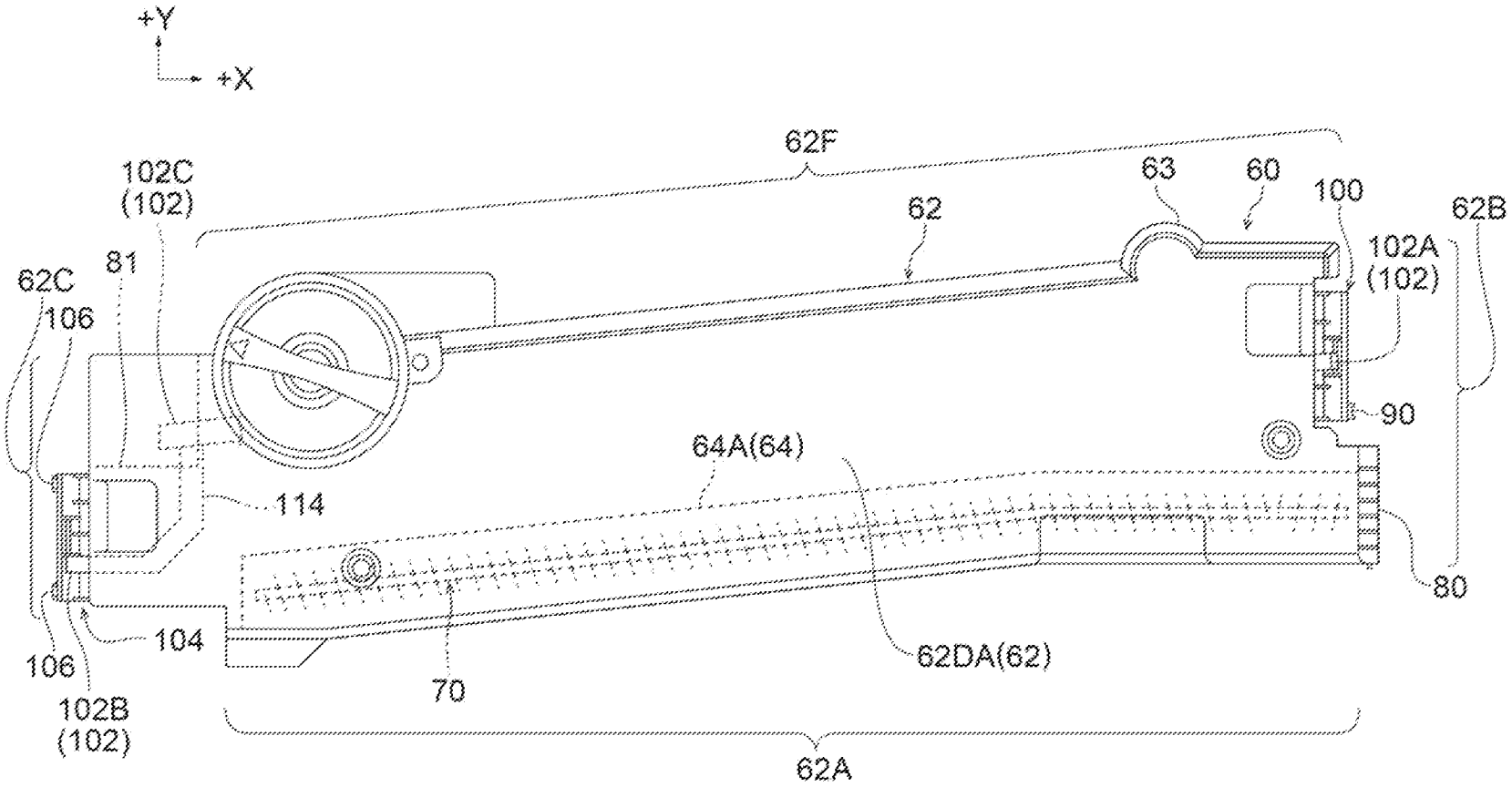
FIG. 8 is a front view of the recovery container of FIG. 6.

As illustrated in FIG. 7 and FIG. 8, an operation handle 88, serving as an example of an operation member, is provided in a front portion (a portion of the container body 62 on a front side in the device depth direction) 62D of the recovery container 60. By operating the operation handle 88, locking of the recovery container 60 to the housing 11 is released, and a recovery port 66 for de eloper, which is an example of a powder, is blocked. In addition, a primary transfer roller 34 of the transfer device 22 is separated from the photoconductor 12 in interlocking with the operation of the operation handle 88. Thereafter, the recovery container 60 is detached from the housing 11, so that the photoconductor units 30 corresponding to respective colors that are attached to the housing 11 are exposed to an outside (see FIG. 3). Accordingly, the photoconductor unit 30 may be accessed.

In addition, in a state where the recovery container 60 is detached, an operation lever 38 provided in the developing device 18 is operated so that the operation lever 38 is retracted from a detachment path of the photoconductor unit 30. Thereafter, the photoconductor unit 30 is pulled out toward the front side in the device depth direction, thereby detaching the photoconductor unit 30 from the housing 11.

Next, an operation of the image forming device 10 will be described.

An operation of each unit of the image forming device 10 is controlled by the control unit 20. In the image forming device 10, the developing device 18 develops a latent image on the photoconductor 12 with a developer serving as a colorant, which is an example of a powder transported from the toner cartridge 28, thereby forming a toner image as an example of a developer image. Further, in the image forming device 10, the transfer device 22 transfers the toner image to a recording medium P, and thereafter the toner image is fixed to the recording medium P by the fixing device 24.

As an example, the developer includes, as main components, a toner serving as an example of a colorant that is charged to a negative polarity and an iron carrier serving as an example of a magnetic body that is charged to a positive polarity, and further includes an additive. The toner is made of for example, a polyester resin.

[Configuration of Main Part]

Next, the recovery container 60 of the pre sent exemplary embodiment will be described in detail.

With the recovery container 60 of the present exemplary embodiment, the developer used in the developing device 18, the developer removed from an intermediate transfer belt 36, and the developer removed from the photoconductor 12 are recovered, and thereafter the recovered developer is collected and is discharged from an external discharge port 68 (see FIGS. 12A, 12B and 12C) described later to a recovery bottle 58 (see FIG. 2 and FIGS. 12A, 12B and 12C) in a lower portion of the housing 11. In the present disclosure, the term "recovery" includes a case where the powder is temporarily kept in a place and a case where the powder is finally kept.

As illustrated in FIGS. 4 to 8, the recovery container 60 includes the container body 62.

The container body 62 has a box shape. Specifically, the container body 62 has a box shape in which a length in a width direction is longer than a length in a thickness direction. Inside the container body 62, a recovery path 64 for recovering the developer is provided. The container body 62 is accommodated in the accommodating portion 50 of the housing 11 so as to be attached to the housing 11. As described above, since the shape of the accommodating portion 50 corresponds to the outer shape of the recovery container 60 (container body 62), the photoconductor 12 and the transfer device 22 are covered by the container body 62 in a state where the container body 62 is accommodated in the accommodating portion 50.

The recovery path 64 is a passage portion for collecting the developer recovered from the recovery port 66, which will be described later, and transporting the collected developer to the external discharge port 68. The recovery path 64 includes branch passages (not shown) extending downward respectively from plural recovery ports 66, and a main passage 64A into which the branch passages merge. The main passage 64A is provided in a lower portion of the container body 62, and extends from one side (a right side in FIGS. 7 and 8) toward the other side (a left side in FIGS. 7 and 8) in the width direction of the container body 62. The developer recovered in the main passage 64A is transported from one side (the left side in FIGS. 7 and 8) to the other side (the right side in FIGS. 7 and 8) in an extending direction of the main passage 64A. Specifically, the main passage 64A is provided with a transporting auger 70 serving as an example of a transporting member that rotates with the extending direction of the main passage 64A as an axial direction. By the rotation of the transporting auger 70, the developer in the main passage 64A is transported from the other side to the one side in the width direction of the container body 62. In other words, the transporting auger 70 transports the powder in the main passage 64A from a side portion 62C to a side portion 62B along the extending direction of the main passage 64A.

The external discharge port 68 (see FIG. 12) is provided in a bottom portion 62A of the container body 62. Specifically, the external discharge port 68 is provided at the other end portion of the main passage 64A in the extending direction, and opens downward. The developer transported through the main passage 64A is discharged to the outside through the external discharge port 68. In the present exemplary embodiment, in a state where the recovery container 60 is attached to the housing 11, the external discharge port 68 is connected to a recovery port 52 provided in a bottom surface 50A of the accommodating portion 50. The recovery port 52 is connected to a port portion of the recovery bottle 58 that is attached on a lower side of the accommodating portion 50 of the housing 11. Therefore, the developer discharged from the external discharge port 68 is collected in the recovery bottle 58 via the recovery port 52.

Figure 12A:
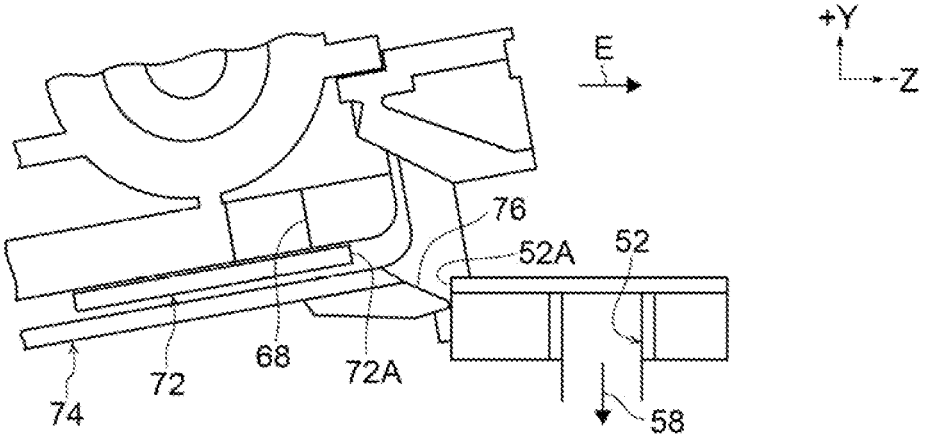
FIG. 12A is an enlarged side view for illustrating an operation of guiding a peripheral portion of a recovery port of a housing by a guide portion of the recovery container.
Figure 12B:
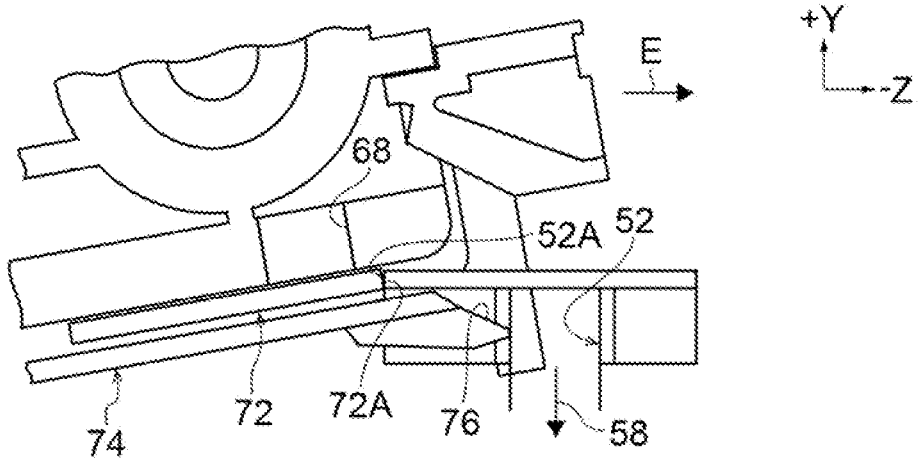
FIG. 12B s an enlarged side view for illustrating an operation in which an opening/closing shutter is pushed and opened by the peripheral portion of the recovery port.
Figure 12C:
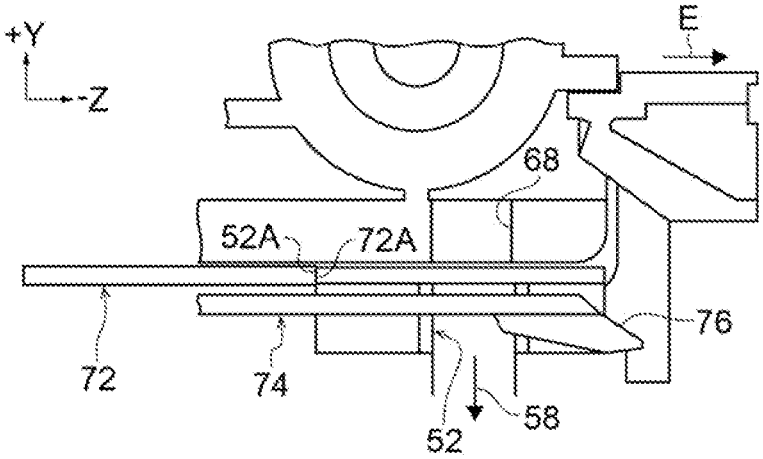
FIG. 12C is an enlarged side view for illustrating a state where an external discharge port and the recovery port are connected to each other.

An opening/closing shutter 72, which is an example of an opening/closing part that closes the external discharge port 68 by being biased in the attachment direction E by a spring member (not shown) (a coil spring, for example), is provided at a portion of the bottom portion 62A of the container body 62 that corresponds to the external discharge port 68. The opening/closing shutter 72 is pushed and opened by a flange portion 52A of the recovery port 52 in an attached state where the container body 62 is attached to the housing 11. Specifically, when the container body 62 is moved in the attachment direction E with respect to the housing 11, as illustrated in FIGS. 12A to 12C, the flange portion 52A of the recovery port 52 comes into contact with an end portion 72A of the opening/closing shutter 72 on the attachment direction E side. Then, when the container body 62 is further moved in the attachment direction E, the opening/closing shutter 72 is pushed toward a side opposite to the attachment direction E, and the external discharge port 68 is opened. The external discharge port 68 and the recovery port 52 are connected to each other.

A guide portion 74 that guides movement of the opening/closing shutter 72 of the container body 62 is provided on an opposite side of the external discharge port 68, with the opening/closing shutter 72 being sandwiched therebetween. As illustrated in FIGS. 10, 12A, 12B and 12C, the guide portion 74 is provided with an inclined portion 76 that extends obliquely in a direction away from the opening/closing shutter 72 from an end portion in the attachment direction E toward the attachment direction E. The inclined portion 76 may guide the flange portion 52A of the recovery port 52 into the opening/closing shutter 72. Specifically, in attaching the container body 62 to the housing 11, when the flange portion 52A of the recovery port 52 comes into contact with the inclined portion 76, the flange portion 52A of the recovery port 52 is guided between the external discharge port 68 and the guide portion 74 in a height direction of the container body 62 by the inclined portion 76. Then, the guided flange portion 52A of the recovery port 52 comes into contact with the end portion 72A of the opening/closing shutter 72 and pushes the opening/closing shutter 72.

Figure 5:
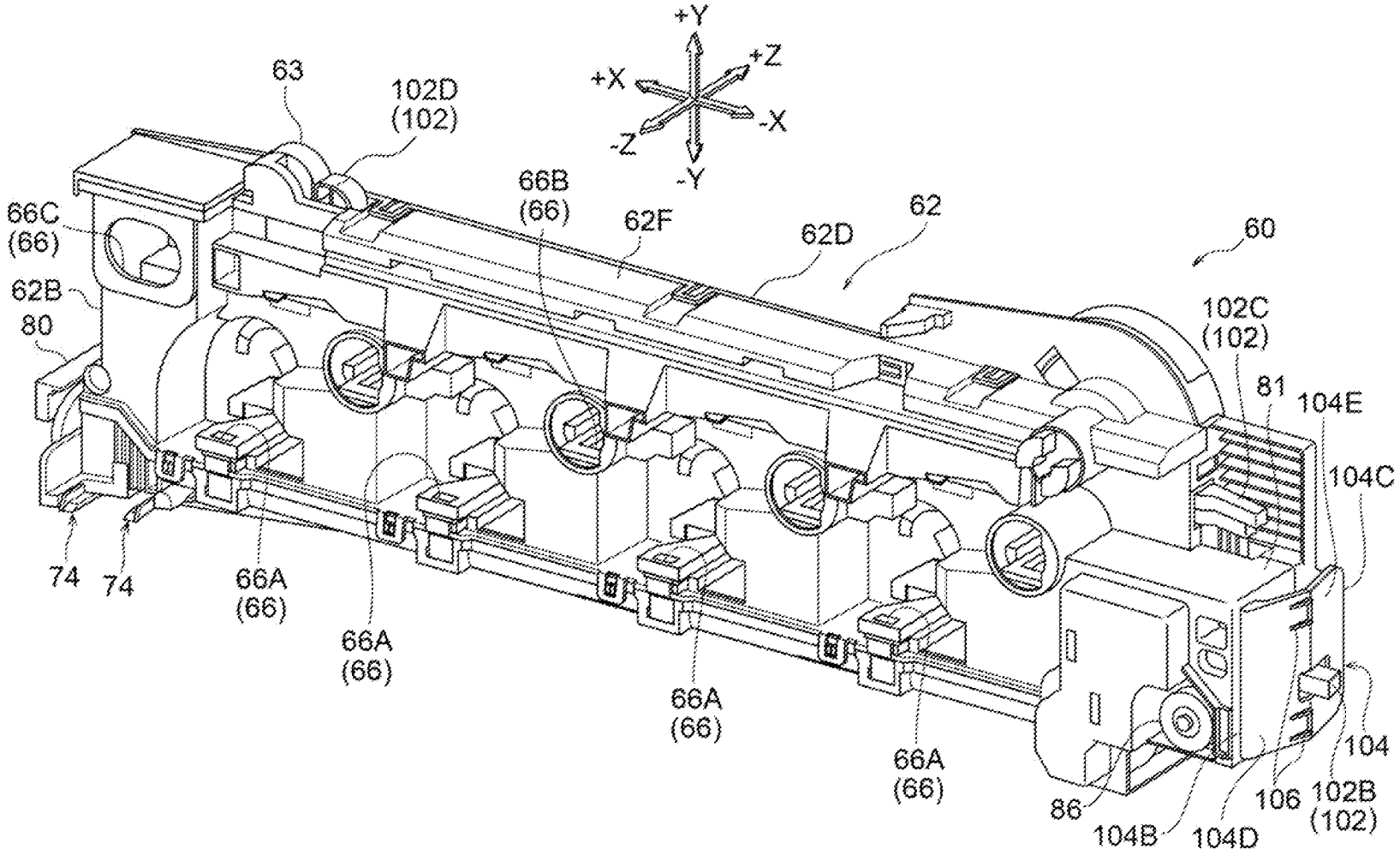
FIG. 5 is a perspective view of the recovery container of FIG. 4 as viewed from a back side, illustrating a state where the recovery container is locked to the housing.
Figure 6:
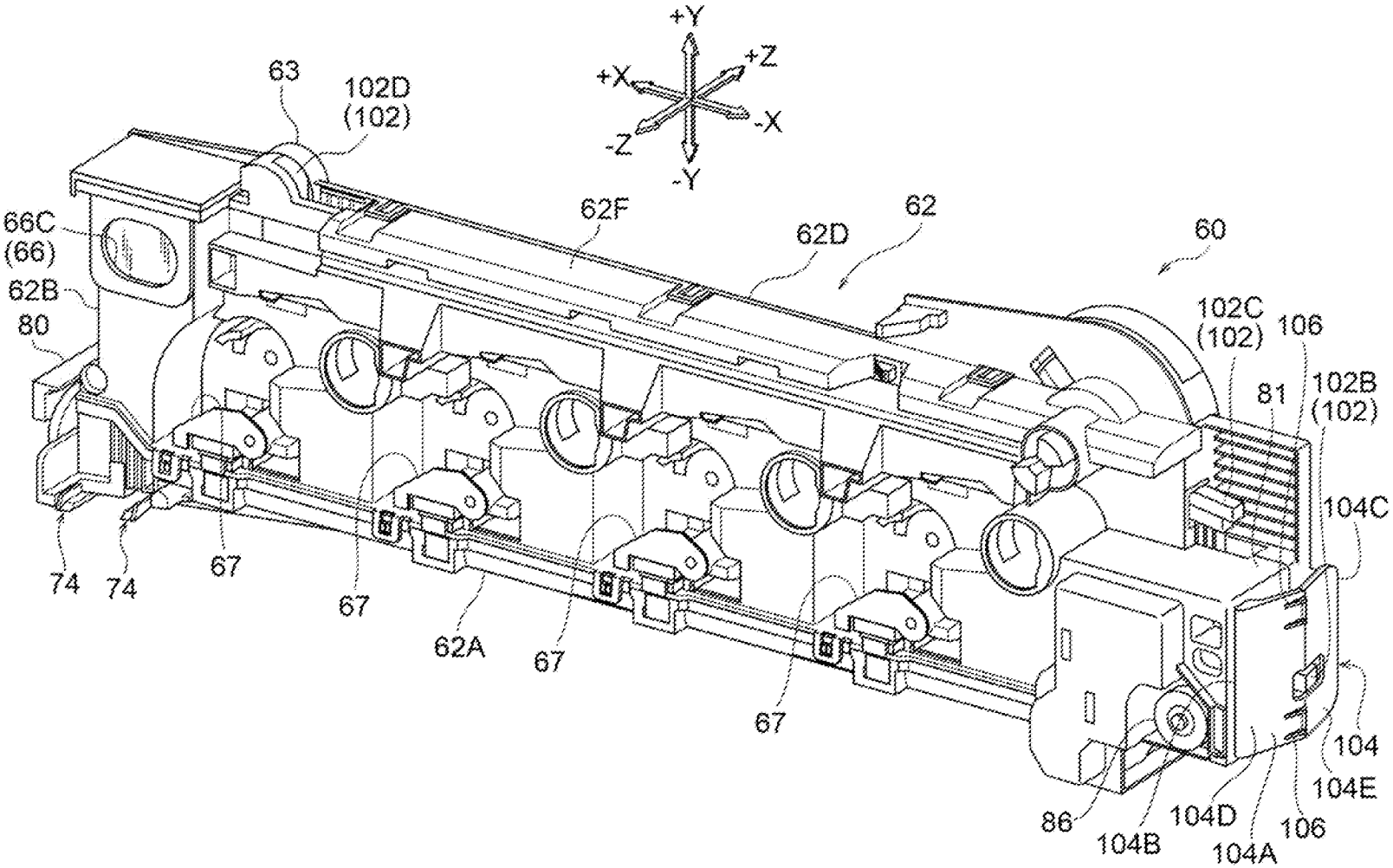
FIG. 6 is a perspective view of the recovery container of FIG. 4 as viewed from the back side, illustrating a state where the recovery container is unlocked from the housing.

As illustrated in FIGS. 5 and 6, in the present exemplary embodiment, the guide portions 74 are respectively provided on both sides in a width direction of the container body 62 with the external discharge port 68 sandwiched therebetween. Since both end portions in a width direction of the opening/closing shutter 72 are supported and guided by these guide portions 74, rattling of the movement of the opening/closing shutter 72 is suppressed. Further, since the pair of guide portions 74 are each provided with the inclined portion 76 described above, the flange portion 52A of the recovery port 52 is guided in a stable state.

A connector 86 (see FIGS. 5 and 6), which is an example of a shaft coupling for rotationally driving the transporting auger 70, is provided at a rear portion 62E (a portion on a rear side in the device depth direction) of the container body 62. Specifically, the connector 86 is provided on a back surface (surface opposite to a front surface 62DA) of the container body 62 and at a lower portion in the vicinity of the side portion 62C to be described later. In a state where the container body 62 is attached to the housing 11, the connector 86 is coupled to a rotation driving unit (not shown) provided in the housing 11, and converts a rotational force of the rotation driving unit into a rotational force of the transporting auger 70. Therefore, in a state where the container body 62 is attached to the housing 11, the rotational force from the rotation driving unit is converted into the rotational force of the transporting auger 70 via the connector 86, and the developer recovered in the main passage 64A is transported toward the external discharge port 68 by the rotation of the transporting auger 70.

Plural recovery ports 66 for recovering the developer from the housing 11 side are provided in the rear portion 62E of the container body 62. These recovery ports 66 are provided on the recovery path 64 of the container body 62. In addition, these recovery ports 66 may be connected to a developer discharge portion 40 serving as an example of a powder discharge portion on the housing 11 side. In a state where the recovery port 66 and the developer discharge portion 40 are connected to each other, the developer discharged from the developer discharge portion 40 is recovered at the recovery port 66 and sent to the recovery path 64 (from the branch passage to the main passage 64A). Specifically, with the recovery port 66 of the present exemplary embodiment, the developer used in the developing device 18, the developer removed from the intermediate transfer belt 36, and the developer removed from the photoconductor 12 are recovered. A recovery port for recovering the developer discharged from the developer discharge portion 40 of the developing device 18 is denoted by a reference sign 66A (see FIG. 5), a recovery port for recovering the developer removed from the photoconductor 12 by the cleaning device 26 is denoted by a reference sign 66B (see FIG. 5), and a recovery port for recovering the developer removed from the intermediate transfer belt 36 by a belt cleaning member (not shown) is denoted by reference sign 66C (see FIG. 5).

The recovery port 66A may be opened and closed by an opening/closing shutter 67 biased in the attachment direction E by a coil spring serving as an example of a biasing member (not shown). In the attached state where the container body 62 is attached to the housing 11, the opening/closing shutter 67 is pushed toward a side opposite to the attachment direction E by a peripheral portion of the developer discharge portion 40 to open the recovery port 66A (see FIG. 6). Ina detached state where the container body 62 is detached from the housing 11, the opening/closing shutter 67 blocks the recovery port 66A (see FIG. 7).

Figure 16:
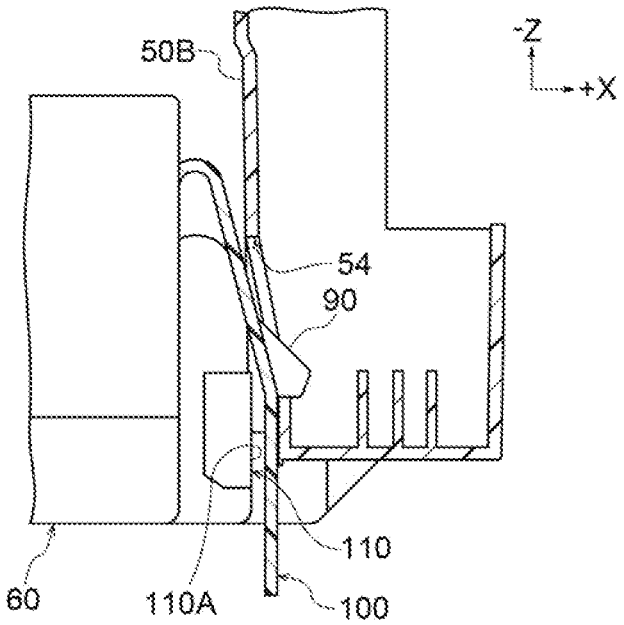
FIG. 16 is an enlarged plan view illustrating a state where the projection is hooked to a hooked portion by moving the recovery container in the attachment direction with respect to the housing.

In addition, an attachment/detachment handle 100 serving as an example of a first grip portion is provided at the side portion 62B on one side (the right side in FIGS. 7 and 8) in the width direction of the container body 62. Specifically, the attachment/detachment handle 100 is provided at an upper portion of the side portion 62B of the container body 62. More specifically, the attachment/detachment handle 100 is provided above a projecting portion 80 of the side portion 62B. The projecting portion 80 is a portion that is provided at a lower portion of the s ide portion 62B on one side in the width direction of the container body 62 and projects outward in the width direction (see FIGS. 7 and 8). The attachment/detachment handle 100 is a plate-shaped spring member of which one end portion 100B is supported by the side portion 62B of the container body 62 and the other end portion 100C is positioned on a side opposite to the one end portion 100B in the attachment direction E. In the detached state of the recovery container 60, the other end portion 100C of the attachment/detachment handle 100 is in a free state. More specifically, as illustrated in FIG. 16, the attachment/detachment handle 100 includes an inclined plate portion 100D that extends from the one end portion 100B toward a side opposite to the attachment direction E and away from the side portion 62B (outward in the width direction of the container body 62) as viewed from above, and a gripping plate portion 100E that extends from an end portion of the inclined plate portion 100D toward the side opposite to the attachment direction E. That is, the attachment/detachment handle 100 has a shape extending from the side portion 62B to the side opposite to the attachment direction E with a gap between the attachment/detachment handle 100 and the side portion 62B. A length of the inclined plate portion 100D is longer than a length of the gripping plate portion 100E.

The other end portion 100C of the attachment/detachment handle 100 projects further toward the other s ide in the thickness direction of the container body 62 (the front side in the device depth direction) with respect to the front surface 62DA of the container body 62. That is, since a part of the gripping plate portion 100E projects to the front side in the device depth direction with respect to the front surface 62DA, it is easy to operate the attachment/detachment handle 100 when detaching the recovery container 60 from the housing 11.

A projection 90, which is an example of a first hook portion, is provided on a surface of the attachment/detachment handle 100 on a side opposite to the container body 62 side. Specifically, the projection 90 is provided on a surface 100A on the other end portion 100C side of the attachment/detachment handle 100. More specifically, the projection 90 is provided at an end portion of the inclined plate portion 100D on the gripping plate portion 100E side. Note that, in the projection 90 of the present exemplary embodiment, a groove portion (recessed portion) that extends along the attachment direction E is formed at a middle portion in the height direction of the container body 62, but the present disclosure is not limited to this configuration. The projection 90 is hooked to a hooked portion 54A formed on a side wall surface 50C (a wall surface on the right side in FIG. 3) of the accommodating portion 50.

Figure 14:
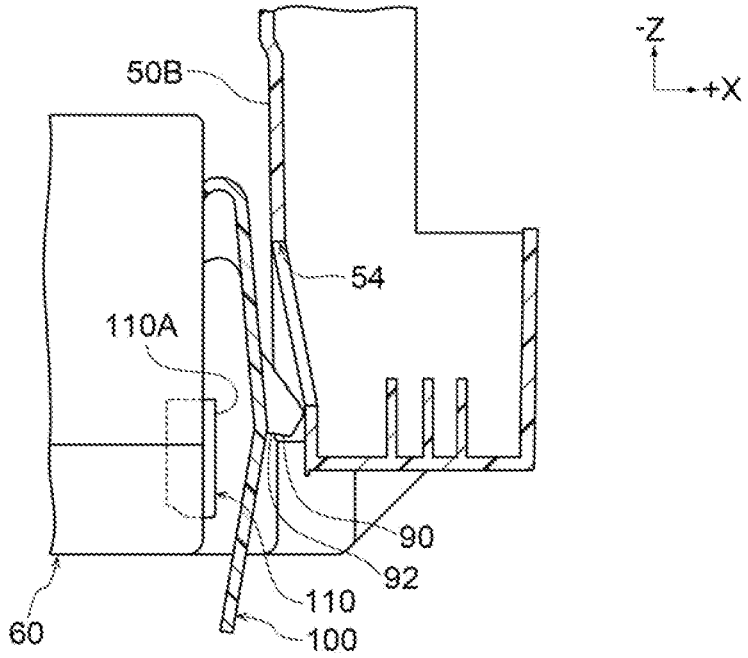
FIG. 14 is an enlarged plan view illustrating a projection in the state where the recovery container is being moved in the attachment direction with respect to the housing.
Figure 17:
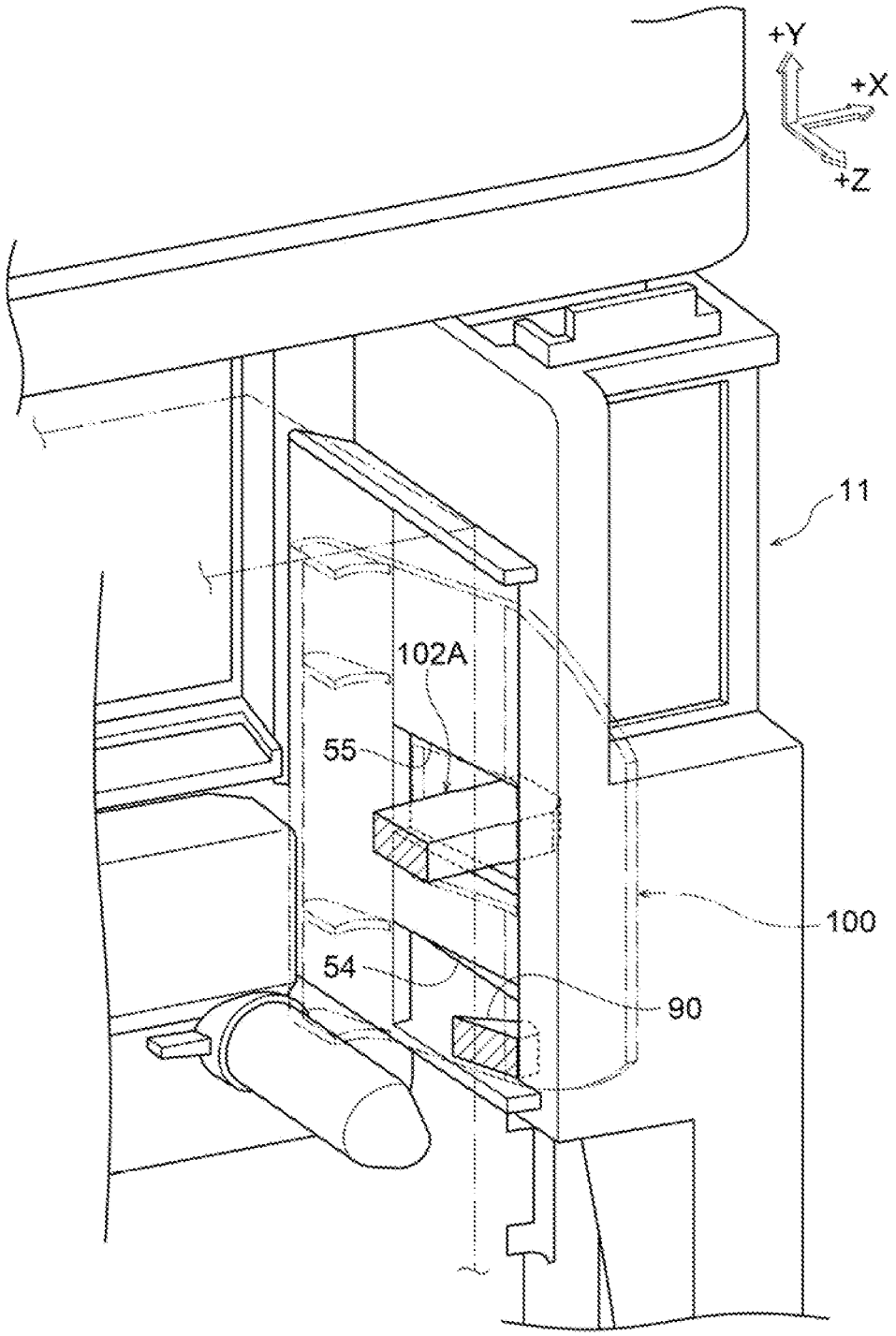
FIG. 17 is an enlarged perspective view of a side surface of an accommodating portion on one side in a device width direction, illustrating a state where the recovery container is attached to the housing.
Figure 18:
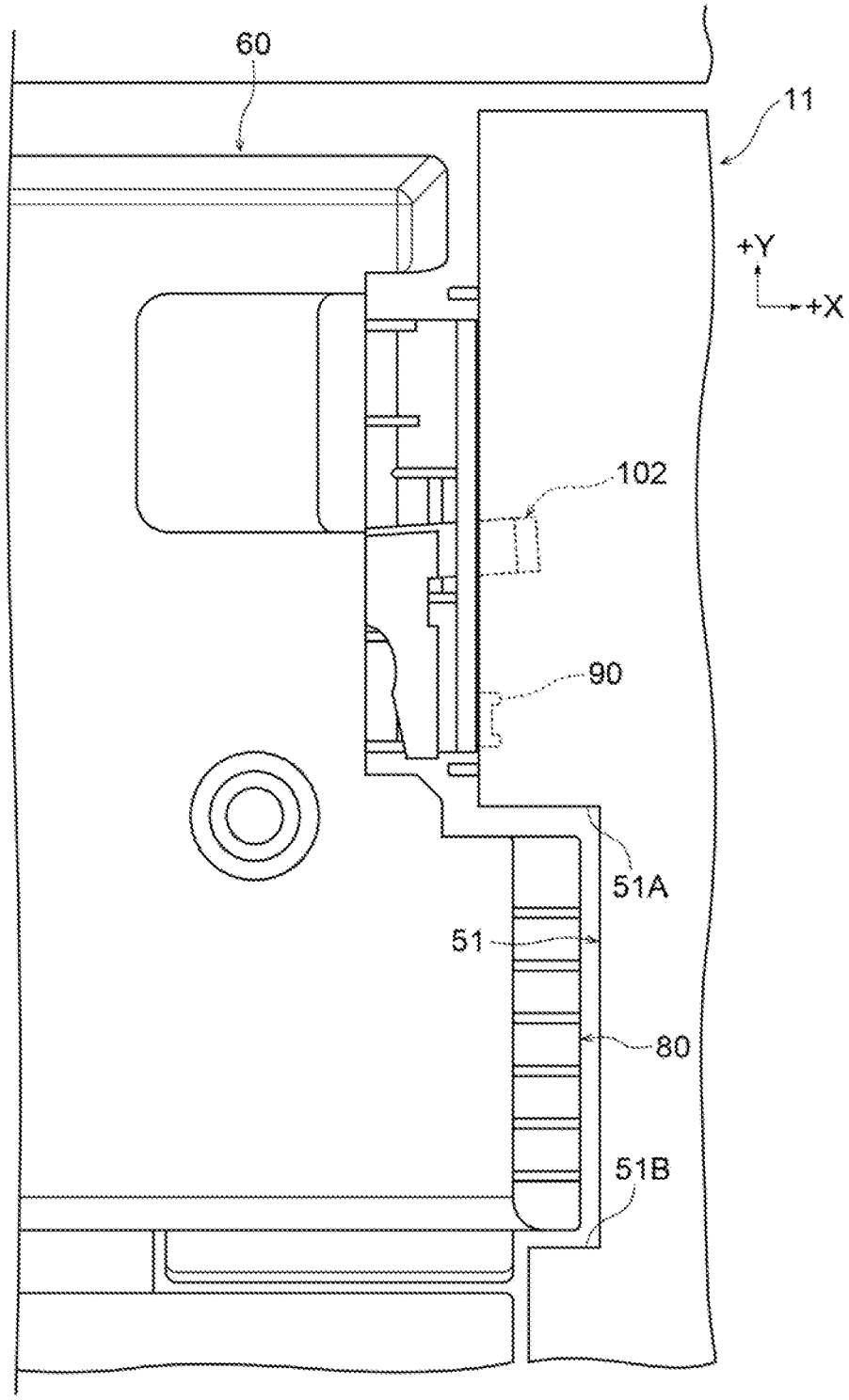
FIG. 18 is a front view illustrating a side portion on one side in a width direction of the recovery container in a state where the recovery container is attached to the housing.

As illustrated in FIG. 14, when the recovery container 60 (the container body 62) is attached to the housing 11, the attachment/detachment handle 100 receives a force toward an inner side in the width direction of the container body 62 from the projection 90 that is in contact with a side wall surface 50B of the accommodating portion 50 on one side (the right side in FIGS. 14 and 17) in the device width direction, and bends around the one end portion 100B, and the other end portion 100C side moves toward the inner side in the width direction of the container body 62. As illustrated in FIG. 16, when the projection 90 leaches an opening 54 of the accommodating portion 50, the projection 90 is hooked to the hooked portion 54A of the accommodating portion 50. The opening 54 is formed above a recessed portion 51 of the side wall surface 50B. The hooked portion 54A refers to an edge portion of the opening 54 on a near side in the device depth direction.

Figure 10:
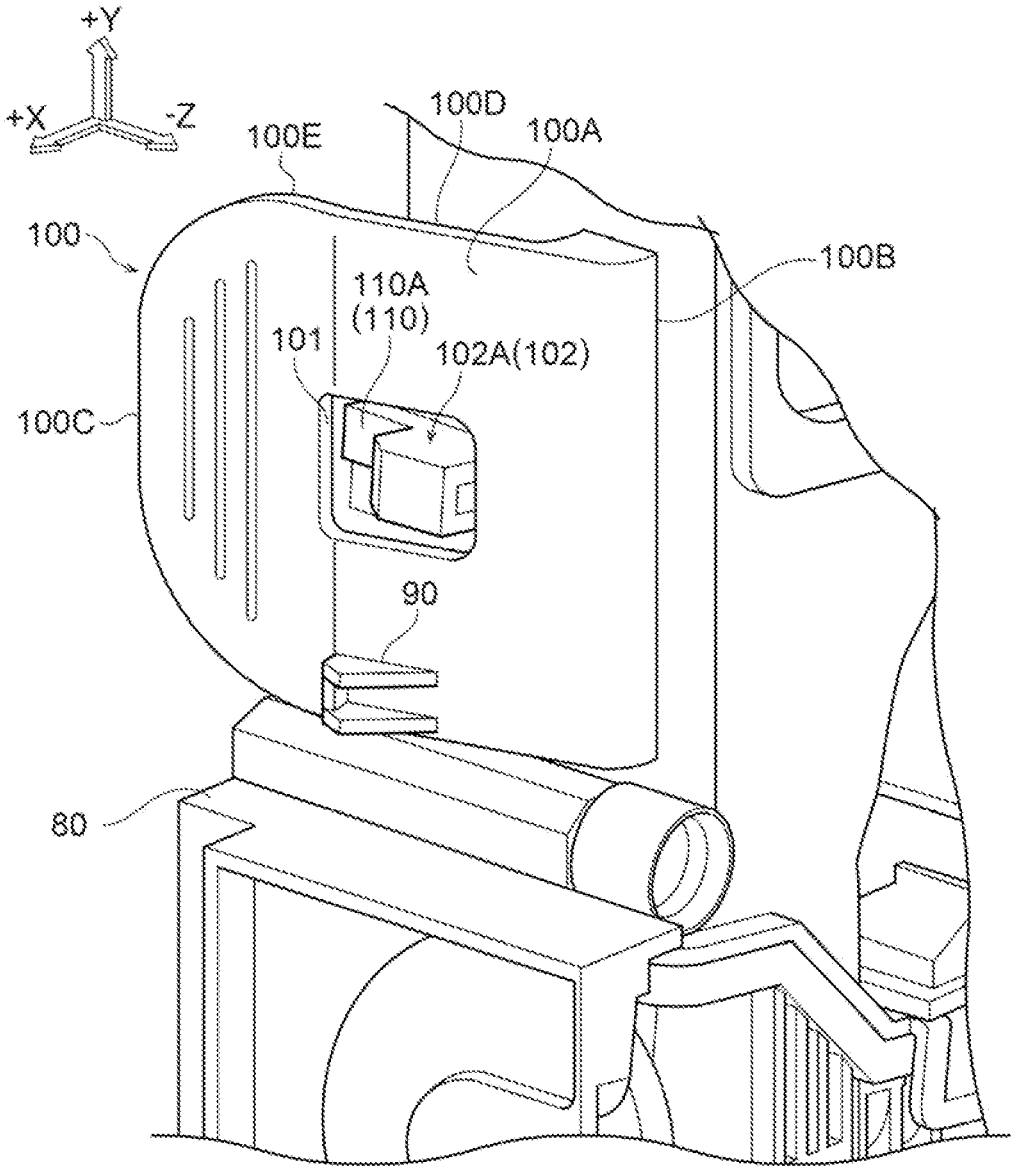
FIG. 10 is a perspective view of the side portion on one side in the width direction of the recovery container of FIG. 9, as viewed from a side opposite to that in FIG. 9.

As illustrated in FIG. 10, the attachment/detachment handle 100 is formed with an opening 101 through which a lock portion 102A of a lock member 102, which will be described later, passes. Specifically, the opening 101 is formed across the inclined plate portion 100D and the gripping plate portion 100E of the attachment/detachment handle 100. The projection 90 is disposed below the opening 101 of the inclined plate portion 100D. Specifically, the projection 90 is formed in the vicinity of a lower end portion of the inclined plate portion 100D.

Figure 22:
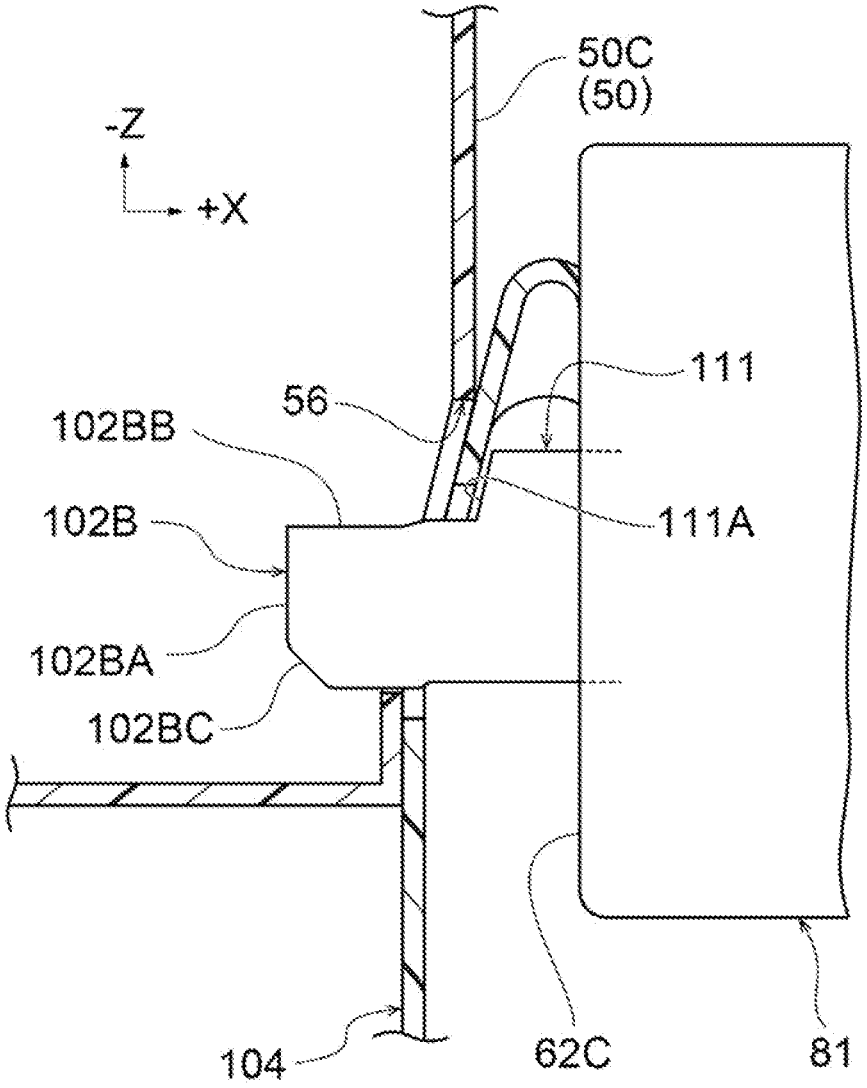
FIG. 22 is an enlarged plan view of a main portion illustrating a state where the lock portion is inserted into the opening by moving the recovery container in the attachment direction with respect to the housing.

In addition, an attachment/detachment handle 104 serving as an example of a second grip portion is provided at the side portion 62C of the container body 62 on the other side (the left side in FIGS. 7 and 8) in the width direction. Specifically, the attachment/detachment handle 104 is provided at a projecting portion 81 provided at a lower portion of the side portion 62C of the container body 62. The projecting portion 81 is a portion that is provided at the lower portion of the side portion 62B of the container body 62 and projects outward in the width direction (see FIGS. 5 and 6). The attachment/detachment handle 104 is a plate-shaped spring member of which one end portion 104B is supported by the projecting portion 81 of the side portion 62C of the container body 62 and the other end portion 104C is positioned on a side opposite to the one end portion 104B in the attachment direction E. In the detached state of the recovery container 60, the other end portion 104C of the attachment/detachment handle 104 is in a free state. More specifically, as illustrated in FIG. 22, the attachment/detachment handle 104 includes an inclined plate portion 104D that extends from the one end portion 104B toward a side opposite to the attachment direction E and away from the side portion 62C (outward in the width direction of the container body 62) as viewed from above, and a gripping plate portion 104E that extends from an end portion of the inclined plate portion 104D toward the side opposite to the attachment direction E. That is, the attachment/detachment handle 104 has a shape extending from the side portion 62C to the side opposite to the attachment direction E with a gap between the attachment/detachment handle 104 and the side portion 62C. A length of the incline d plate portion 104D is longer than a length of the gripping plate portion 104E.

The other end portion 104C of the attachment/detachment handle 104 projects further toward the other s ide in the thickness direction of the container body 62 (the front side in the device depth direction) with respect to the front surface 62DA of the container body 62. That is, since a part of the gripping plate portion 104E projects to the front side in the device depth direction with respect to the front surface 62DA, it is easy to operate the attachment/detachment handle 104 when detaching the recovery container 60 from the housing 11.

A projection 106, which is an example of a second hook portion, is provided on a surface of the attachment/detachment handle 104 on a side opposite to the container body 62 side. Specifically, as illustrated in FIGS. 5 and 6, the projection 106 is provided on a surface 104A on the other end portion 104C side of the attachment/detachment handle 104. More specifically, the projection 106 is provided at an end portion of the inclined plate portion 104D on the gripping plate portion 104E side. Note that, in the projection 106 of the present exemplary embodiment, a groove portion (recessed portion) that extends along the attachment direction E is formed at a middle portion in the height direction of the container body 62, but the present disclosure is not limited to this configuration. The projection 106 is hooked to a hooked portion (not shown) formed on the side wall surface 50C (wall surface on the left side in FIG. 3) of the accommodating portion 50.

As illustrated in FIG. 14, when the recovery container 60 (the container body 62) is attached to the housing 11, the attachment/detachment handle 104 receives a force toward an inner side in the width direction of the container body 62 from the projection 106 that is in contact with the side wall surface 50C of the accommodating portion 50, and bends around the one end portion 104B, and the other end portion 104C side moves toward the inner side in the width direction of the container body 62. When the projection 106 reaches the hooked portion of the side wall surface 50C, the projection 106 is hooked to the hooked portion.

As illustrated in FIGS. 5 and 22, the attachment/detachment handle 104 is formed with an opening 105 through which a lock portion 102C of the lock member 102, which will be described later, passes. Specifically, the opening 105 is formed across the inclined plate portion 104D and the gripping plate portion 104E of the attachment/detachment handle 104. Further, a pair of the projections 106 are formed so as to sandwich the opening 105 of the inclined plate portion 104D in the height direction of the container body 62.

Here, the projection 90 and the projection 106 of the recovery container 60 are hooked to the hooked portion 54A and the hooked portion (not shown), respectively, so that the recovery container 60 is held (attached) in the housing 11. Further, the other end portions 100C and 104C of the respective attachment/detachment handle 100 and the attachment/detachment handle 104 on both side s of the recovery container 60 are gripped and pressed toward the inner side in the width direction, whereby the projection 90 and the projection 106 are detached from the hooked portion 54A and the hooked portion (not shown) (the hooking is released). In this state, the recovery container 60 is pulled from the housing 11 toward the side opposite 1D the attachment direction E so that the recovery container 60 is detached from the housing 11.

As illustrated in FIGS. 7 and 8, the container body 62 is provided with the lock member 102. The lock member 102 is a member for maintaining the attached state of the recovery container 60 to the housing 11 by an operation of the operation handle 88. The lock member 102 includes the first lock portion 102A serving as an example of a first insertion portion, a second lock portion 102B serving as an example of a second insertion portion, and a third lock portion 102C serving as an example of a third insertion portion.

Figure 15:
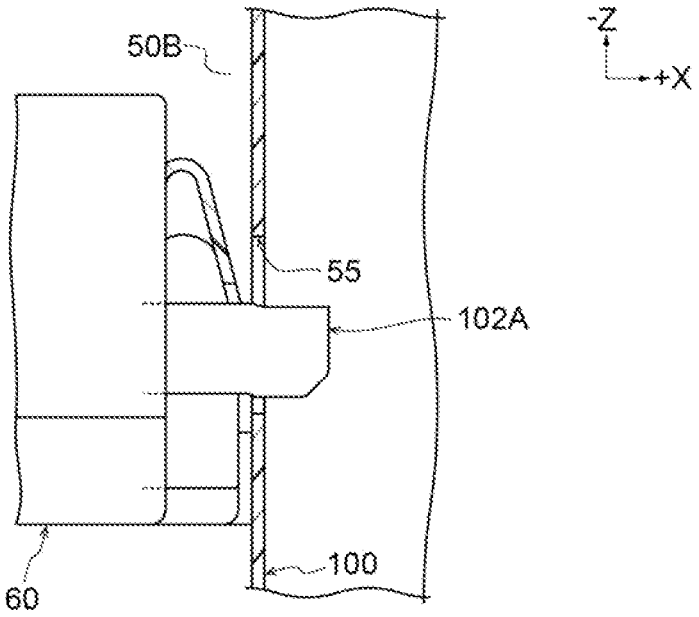
FIG. 15 is an enlarged plan view illustrating a state where the lock portion is inserted into an opening by moving the recovery container in the attachment direction with respect to the housing.

As illustrated in FIGS. 7 and 8, the lock portion 102A is configured to be capable of protruding (in other words, retractable) from the side portion 62B of the container body 62. Specifically, the lock portion 102A protrudes outward in the width direction of the container body 62 from the side portion 62B of the container body 62, and is to be inserted into the opening 55 provided in the side wall surface 50B of the accommodating portion 50 (see FIG. 15). More specifically, movement of the lock portion 102A in a protruding direction thereof, that is, movement to one side in the width direction of the container body 62 is made possible, and a protruding height thereof from the side portion 62B is increased (a protruding amount is increased) by this movement, and the lock portion 102A is inserted into the opening 55. Here, "a lock portion is capable of protruding from a side portion of the container body" includes a mode in which a tip end of the lock portion protrudes from the side portion due to movement of the lock portion in the protruding direction, and a mode in which a protruding height of a portion protruding from a side portion of the lock portion increases due to movement of the lock portion in the protruding direction.

Figure 9:
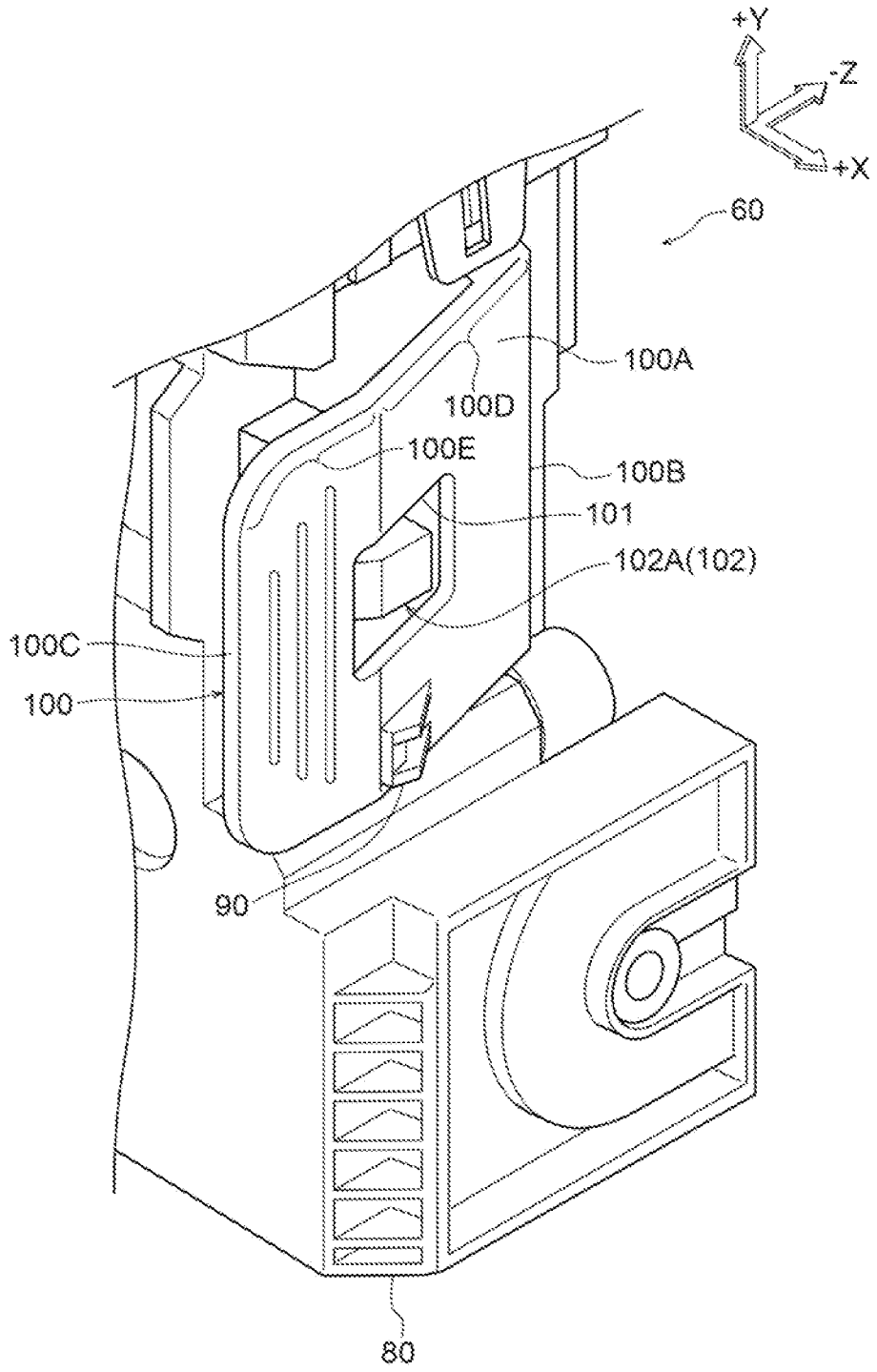
FIG. 9 is a perspective view of a side portion on one side in a width direction of the recovery container of FIG. 4.
Figure 13:
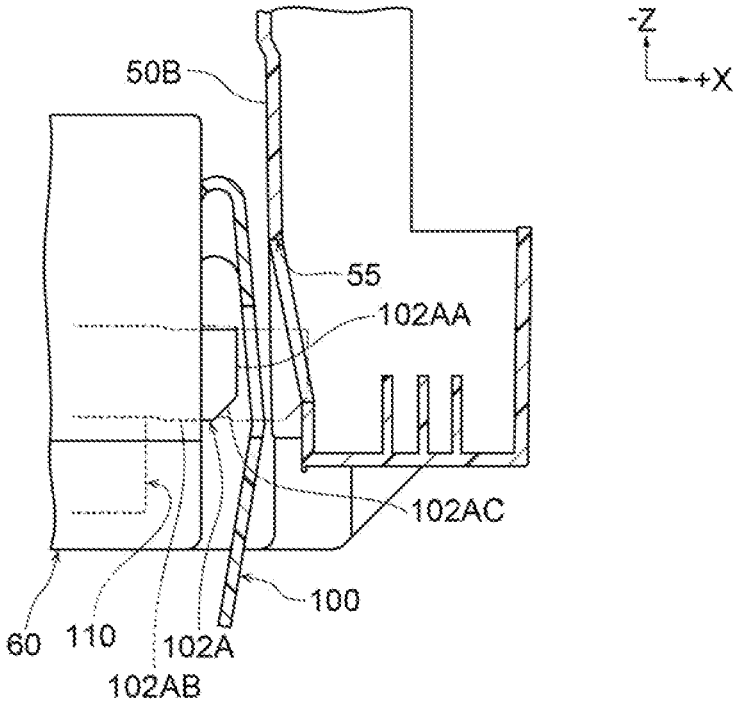
FIG. 13 is an enlarged plan view illustrating a lock portion in a state where the recovery container is being moved in an attachment direction with respect to the housing.

As illustrated in FIGS. 9 and 13, the lock portion 102A is formed in a substantially rectangular parallelepiped shape, and an inclined surface 102AC is formed from a tip end surface 102AA toward a side surface 102AB on the other side in the thickness direction of the container body 62 (the front side in the device depth direction). When the lock portion 102A is moved outward in the width direction of the container body 62, that is, in the protruding direction by the operation of the operation handle 88, the lock portion 102A passes through the opening 101 of the attachment/detachment handle 100 and is inserted into the opening 55 of the accommodation portion 50. That is, the lock portion 102A in a protruding state penetrates the attachment/detachment handle 100.

In addition, the lock portion 102A is provided with a restriction portion 110 that restricts approach of the attachment/detachment handle 100 to the side portion 62B when the lock portion 102A is in a protruding state. Specifically, the restriction portion 110 is integrally formed with a periphery of the lock portion 102A. The restriction portion 110 is a portion protruding from the side surface 102AB of the lock portion 102A. Therefore, in interlocking with the operation of the lock portion 102A protruding outward in the width direction of the container body 62 from the side portion 62B, the restriction portion 110 also moves outward in the width direction of the container body 62. Here, when the recovery container 60 is attached to the housing 11 and the lock member 102 is in a locked state, a restriction surface 110A (a surface on an outer side in the width direction of the container body 62) of the restriction portion 110 faces a back surface of the attachnent/detachment handle 100. Therefore, in the locked state by the lock member 102, the movement of the attachment/detachment handle 100 toward the inner side in the width direction of the container body 62 is restricted (as an example, prevented) by the restriction portion 110, and thus an erroneous operation of the attachment/detachment handle 100 is prevented.

As illustrated in FIGS. 7 and 8, the lock portion 102B is configured to be capable of protruding (in other words, retractable) from the side portion 62C of the container body 62. Specifically, the lock portion 102B protrudes outward in the width direction of the container body 62 from the projecting portion 81 of the side portion 62C of the container body 62, and is to be inserted into an opening 56 provided in the side wall surface 50C of the accommodating portion 50. More specifically, movement of the lock portion 102B in a protruding direction thereof, that is, movement to the other side in the width direction of the container body 62 is made possible, and a protruding height thereof from the side portion 62C is increased (a protruding amount is increased) by this movement, and the lock portion 102B is inserted into the opening 56 (see FIG. 22).

The lock portion 102B is formed in a substantially rectangular parallelepiped shape as illustrated in FIG. 5, and an inclined surface 102BC is formed from a tip end surface 102BA toward a side surface 102BB on the other side in the thickness direction of the container body 62 (the front side in the device depth direction) (see FIG. 22). When the lock portion 102B is moved outward in the width direction of the container body 62, that is, in the protruding direction by the operation of the operation handle 88, the lock portion 102B passes through the opening 105 of the attachment/detachment handle 104 and is inserted into the opening 56 of the accommodating portion 50. That is, the lock portion 102B in a protruding state penetrates the attachment/detachment handle 104.

In addition, the lock portion 102B is provided with a restriction portion 111 that restricts approach of the attachment/detachment handle 104 to the side portion 62C when the lock portion 102B is in a protruding state. Specifically, the restriction portion 111 is integrally formed with a periphery of the lock portion 102B. The restriction portion III is a portion protruding from the side surface 102BB of the lock portion 102B. Therefore, in interlocking with the operation of the lock portion 102B protruding outward in the width direction of the container body 62 from the side portion 62C, the restriction portion 111 also moves outward in the width direction of the container body 62. Here, in a state where the recovery container 60 is attached to the housing 11 and locked by the lock member 102, a restriction surface 111A of the restriction portion 111 (a surface on an outer side in the width direction of the container body 62) faces a back surface of the attachment/detachment handle 104. Therefore, when the lock member 102 is in the locked state, the movement of the attachment/detachment handle 104 toward the inner side in the width direction of the container body 62 is restricted (as an example, prevented) by the restriction portion 111, and thus an erroneous operation of the attachment/detachment handle 104 is prevented.

As illustrated in FIGS. 5 and 6, the lock portion 102C is configured to be capable of protruding (in other words, retractable) from an upper portion of the side portion 62C of the container body 62. Specifically, the lock portion 102C protrudes outward in the width direction of the container body 62 from the upper portion of the side portion 62C of the container body 62, and is to be inserted into the opening 56 provided in the side wall surface 50C of the accommodating portion 50. More specifically, the lock portion 102C protrudes outward in the width direction of the container body 62 from an upper side of the projecting portion 81 of the side portion 62C. More specifically, movement of the lock portion 102C in a protruding direction thereof, that is, movement to the other side in the width direction of the container body 62 is made possible, and a protruding height thereof from the side portion 62C is increased (a protruding amount is increased) by this movement, and the container body 62 is inserted into an opening 57 (see FIG. 2).

The lock portion 102C is formed in a substantially rectangular parallelepiped shape as illustrated in FIGS. 5 and 6, and is inserted into the opening 56 (see FIG. 3) of the accommodating portion 50 when being moved in the protruding direction, that is, outward in the width direction of the container body 62 by the operation of the operation handle 88.

Figure 20:
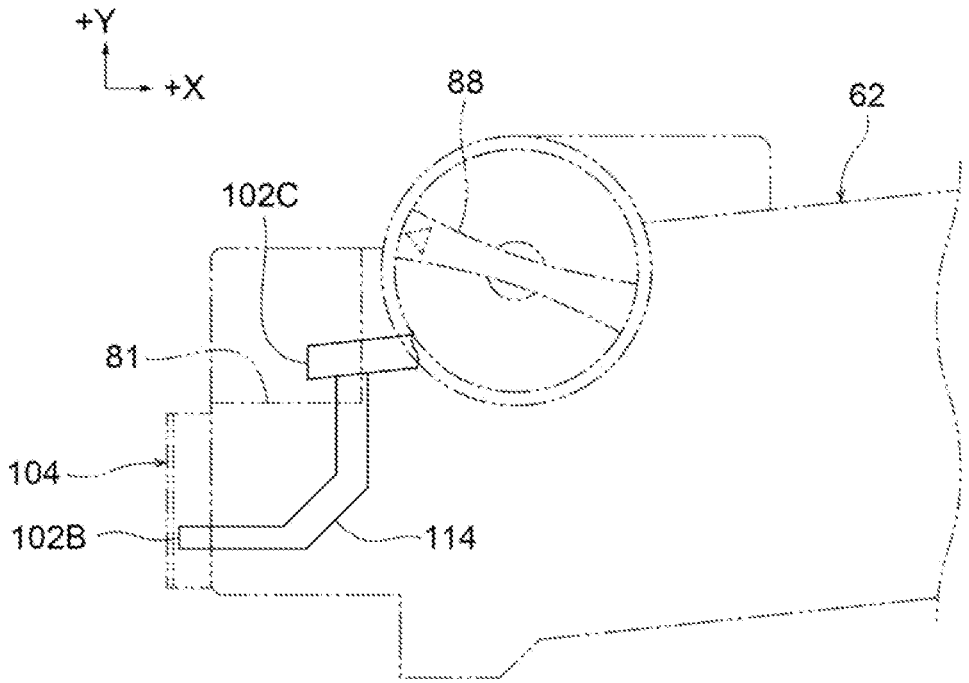
FIG. 20 is a front view for illustrating an operation of two lock portions around the side portion on the other side in the width direction of the recovery container when the recovery container is in an unlocked state.
Figure 21:
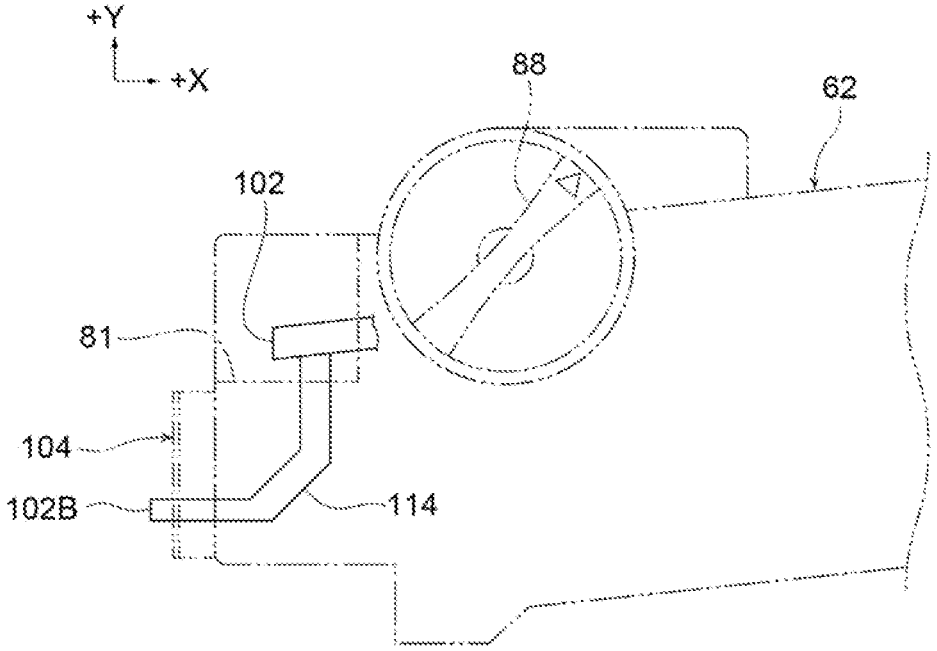
FIG. 21 is a front view for illustrating an operation of the two lock portions around the side portion on the other side in the width direction of the recovery container when the recovery container is in a locked state.

As illustrated in FIGS. 20 and 21, the lock portion 102B and the lock portion 102C are coupled by a coupling portion 114. Therefore, in the present exemplary embodiment, the operation of the lock portion 102B and an operation of the lock portion 102C are in interlocking with each other.

A protruding operation of each of the lock portion 102A, the lock portion 102B, and the lock portion 102C is in interlocking with the operation of the operation handle 88. That is, by operating the operation handle 88, the lock portion 102A, the lock portion 102B, and the lock portion 102C may be made to protrude outward in the width direction of the container body 62.

As illustrated in FIGS. 7 and 8, the lock portion 102B and the lock portion 102C are disposed so as to be separated from each other in the height direction of the container body 62. Further, the lock portion 102A, the lack portion 102B, and the lock portion 102C are disposed so as to be deviated in the height direction of the container body 62.

Figure 19:
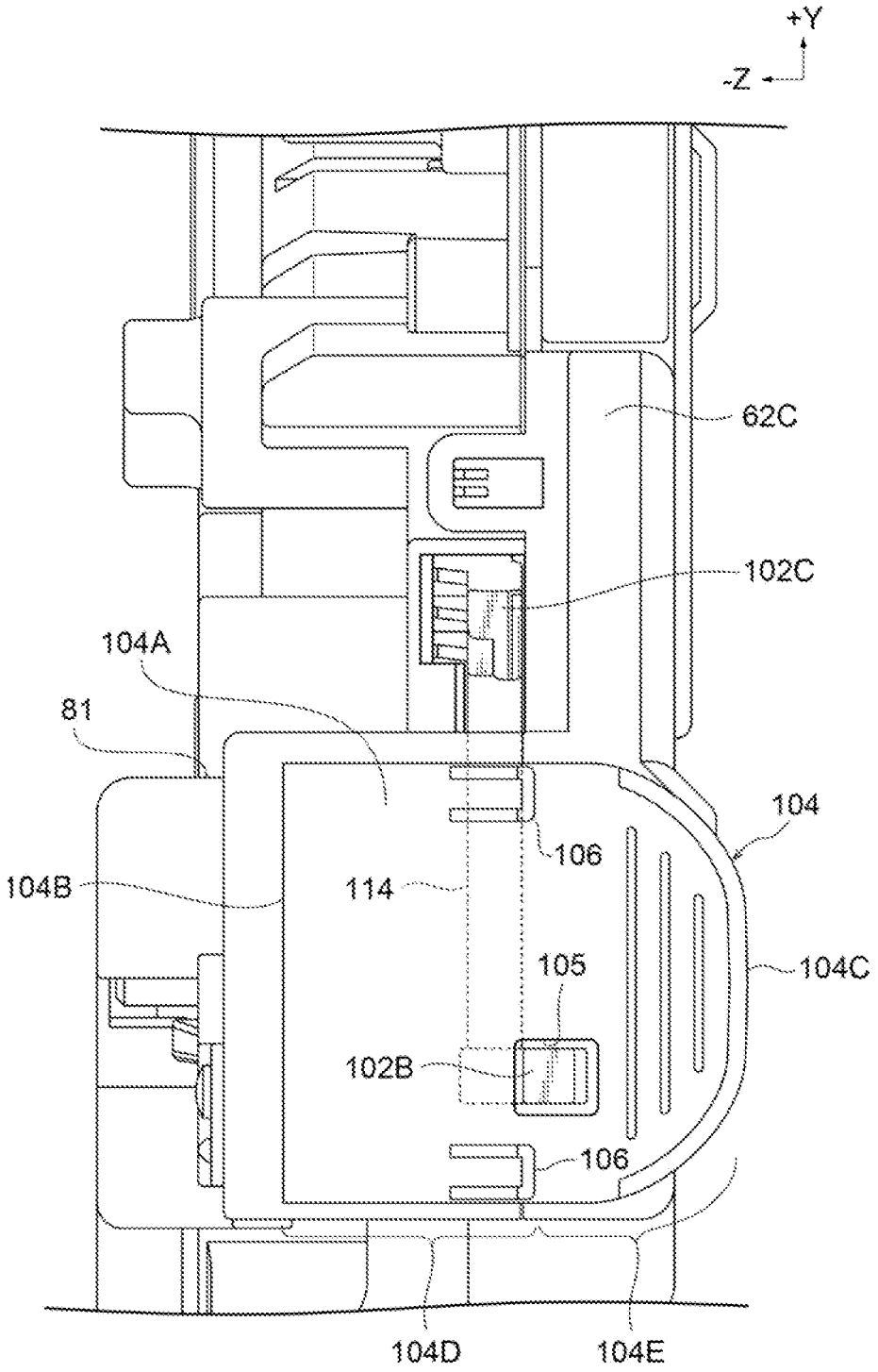
FIG. 19 is a side view of a side portion on the other side in the width direction of the recovery container of FIG. 9, as viewed from a lateral side.

When viewed from the attachment direction E of the container body 62, the lock portion 102B and the connector 86 overlap each other in the height direction of the container body 62. In other words, the lock portion 102B is disposed on an outer side in the width direction of the container body 62 with respect to the connector 86 (see FIG. 19).

In addition, the lock member 102 includes a lock portion 102D that slides in the width direction of the container body 62 from a state of being accommodated in an accommodating portion 63 provided in an upper portion 62F of the container body 62 and protrudes to the upper portion 62F of the container body 62. The accommodating portion 63 is a portion that protrudes upward in the height direction of the container body 62 from the upper portion 62F of the container body 62, and is capable of accommodating the lock portion 102D. The lock portion 102D comes out of the accommodating portion 63 by sliding to the other side in the width direction of the container body 62 from the state of being accommodated in the accommodating portion 63, and enters a state of protruding to the upper portion 62F of the container body 62.

The lock portion 102D slides in the width direction of the container body 62 by the operation of the operation handle 88 and protrudes to the upper portion 62F of the container body 62, thereby being hooked to a hooked portion (not shown) provided on a ceiling surface 50D of the accommodating portion 50. The lock portion 102D protrudes from the container body 62 together with the lock portion 102A, the lock portion 102B, and the lock portion 102C in interlocking with the operation of the operation handle 88.

The lock portion 102A may be configured to move linearly in the width direction of the container body 62 and protrude outward in the width direction from the side portion 62B by the operation of the operation handle 88, or may be configured to protrude outward in the width direction from the side portion 62B by rotational movement. The lock portion 102B, the lock portion 102C, and the lock portion 102D may have the same configuration as the lock portion 102A.

The operation handle 88 is provided in the front portion 62D of the container body 62. The operation handle 88 is coupled to the lock member 102. By operating the operation handle 88, it is possible to switch between locking (keeping of an attached state) and unlocking (release of the attached state) of the recovery container 60 by the lock member 102 by an interlocking mechanism (not shown). Specifically, when the operation handle 88 is rotated clockwise in a state where the recovery container 60 is attached to the housing 11, the lock member 102 is operated by an operation force of the operation handle 88, and the lock portion 102A, the lock portion 102B, and the lock portion 102C protrude from the container body 62 so that the attachment state of the collection container 60 to the housing 11 is locked. At this time, an opening/closing mechanism (not shown) included in the interlocking mechanism is operated by the operation of the operation handle 88, and the recovery port 66A is opened. In addition, the primary transfer roller 34, which is separated from the photoconductor 12, is brought close to the photoconductor 12 by a moving mechanism (not shown). On the other hand, when the operation handle 88 is rotated counterclockwise, the lock member 102 is operated by the operation force of the operation handle 88, and the attachment state of the recovery container 60 to the housing 11 is unlocked. At this time, the opening/closing mechanism (not shown) is operated by the operation of the operation handle 88, and the recovery port 66A is blocked. In addition, the primary transfer roller 34 is separated from the photoconductor 12 by the moving mechanism (not shown).

Next, an operation of the present exemplary embodiment will be described.

In the recovery container 60, when the operation handle 88 is operated, the lock portion 102A and the lock portion 102C of the lock member 102 protrude in mutually opposite directions in the width direction of the container body 62, and the lock portion 102B protrudes in the same direction as the lock portion 102C. When the lock portion 102A is inserted into the opening 55, the lock portion 102B is inserted into the opening 56, and the lock portion 102C is inserted into the opening 57, the recovery container 60 is locked to the housing 11.

Here, in the recovery container 60, since the recovery container 60 is locked to the housing 11 at least at three portions of the lock portion 102A, the lock portion 102B, and the lock portion 102C, it is possible to stabilize an attachment posture of the container body 62 as compared with a configuration in which the attachment posture of the container body 62 is kept only by the pair of lock portions 102A and 102C protruding in mutually opposite directions in the width direction of the container body 62. For example, rotation of the container body 62 with the width direction of the container body 62 serving as a rotation axis may be restricted.

In the recovery container 60, the container body 62 has a shape in which the length of the container body 62 in the height direction is longer than the length of the container body 62 in the thickness direction, and the lock portion 102B and the lock portion 102C are disposed to be separated from each other in the height direction of the container body 62. Therefore, in the recovery container 60, the attachment posture of the container body 62 may be stabilized as compared with a configuration in which the lock portion 102B and the lock portion 102C are disposed to be separated from each other in the thickness direction of the container body 62.

In the recovery container 60, the lock portion 102A, the lock portion 102B, and the lock portion 102C are disposed so as to be deviated from one another in the height direction of the container body 62. Therefore, in the recovery container 60, the attachment posture of the container body 62 may be stabilized as compared with a configuration in which the lock portion 102A and the lock portion 102B or the lock portion 102A and the lock portion 102C are located at the same position in the height direction of the container body 62.

In the recovery container 60, the protruding operation of each of the lock portion 102A, the lock portion 102B, and the lock portion 102C s interlocked with the operation of the operation handle 88. Therefore, with respect to the recovery container 60, the container body 62 may be attached to the attachment target by a single operation, as compared with a configuration in which the protruding operations of the lock portion 102A, the lock portion 102B, and the lock portion 102C are performed by separate operation members.

In the recovery container 60, the attachment/detachment handle 100 and the projection 90 are provided on the side portion 62B of the container body 62, and the attachment/detachment handle 104 and the projection 106 are provided on the side portion 62C. When the recovery container 60 is accommodated in the accommodating portion 50, the projection 90 is hooked to the hooked portion 54A, the projection 106 is hooked to the hooked portion (not shown), and the recovery container 60 is temporarily attached (temporarily fixed) to the accommodating portion 50. When the operation handle 88 is operated in this state, the recovery container 60 is locked (stably fixed) to the housing 11.

In the recovery container 60, the lock portion 102B in a protruding state penetrates the attachment/detachment handle 104. Therefore, in the recovery container 60, the lock portion 102B may be set freely at a position with respect to the side portion 62C as compared with a configuration in which the lock portion 102B is disposed at a position avoiding the attachment/detachment handle 104.

In the recovery container 60, the lock portion 102A in a protruding state penetrates the attachment/detachment handle 100. Therefore, in the recovery container 60, the lock portion 102A may be set freely at a position with respect to the side portion 62B as compared with a configuration in which the lock portion 102A is disposed at a position avoiding the attachment/detachment handle 100.

In the recovery container 60, the lock portion 102B is provided with the restriction portion 111 that restricts approach of the attachment/detachment handle 104 to the side portion 62C when the lock portion 102B is in a protruding state. Therefore, in the recovery container 60, when the operation handle 88 is in the locked state, the approach of the attachment/detachment handle 104 to the side portion 62C is restricted by the contact with the restriction portion 111, and thus the operation of the attachment/detachment handle 104 to the inner side in the width direction of the container body 62 is restricted. Therefore, in the recovery container 60, it is possible to prevent an erroneous operation of the attachment/detachment handle 104.

In the recovery container 60, the lock portion 102A is provided with the restriction portion 110 that restricts approach of the attachment/detachment handle 100 to the side portion 62B when the lock portion 102A is in a protruding state. Therefore, in the recovery container 60, when the operation handle 88 is in the locked state, the approach of the attachment/detachment handle 100 to the side portion 62B is restricted by the contact with the restriction portion 110, and thus the operation of the attachment/detachment handle 100 to the inner side in the width direction of the container body 62 is restricted. Therefore, in the recovery container 60, it is possible to prevent an erroneous operation of the attachment/detachment handle 100.

In the recovery container 60, the transporting auger 70 is provided in the container body 62, and the connector 86 is provided in the side portion 62C side of the rear portion 62E of the container body 62. Therefore, in the recovery container 60, it is possible to prevent a fitting failure between the rotation driving unit (not shown) provided in the housing 11 and the connector 86 of the container body 62, as compared with a configuration in which the connector 86 is provided in the side portion 62B of the rear portion 62E of the container body 62.

In the recovery container 60, the lock portion 102B and the connector 86 overlap each other in the height direction of the container body 62 as viewed from the attachment direction E. Therefore, in the recovery container 60, as compared with a configuration in which the lock portion 102B and the connector 86 are separated from each other in the height direction of the container body 62 as viewed from the attachment direction E, it is possible to prevent a fitting failure between the rotation driving unit (not shown) provided in the housing 11 and the connector 86 of the container body 62.

In the image forming device 10, since the recovery container 60 is used, the colorant discharged from the developing device 18 may be recovered by the recovery container 60, as compared with a configuration in which a recovery container in which the attachment posture of the container body is kept by only a pair of insertion portions protruding in mutually opposite directions to each other in the width direction of the container body 62 is used.

In the recovery container 60 of the above-described exemplary embodiment, the developer once recovered by the recovery container 60 is discharged from the external discharge port 68 to the recovery bottle 58 attached to the housing 11 through the recovery port 52, but the present disclosure is not limited to this configuration. Instead of providing the external discharge port 68 in the recovery container 60, the recovery container 60 may be replaced by a new one after a certain amount of developer is recovered.

In the recovery container 60 of the exemplary embodiment described above, the lock portion 102B is configured to protrude from the side portion 62C of the container body 62, but the present disclosure is not limited to this configuration. For example, the lock portion 102B may be configured to protrude from the side portion 62B of the container body 60. Also in this case, since the container body 62 is locked to the housing 11 at least at three portions by the lock portion 102A, the lock portion 102B, and the lock portion 102C, the same operation as that of the above-described exemplary embodiment may be obtained.

In the recovery container 60 of the exemplary embodiment described above, the lock portion 102A, the lock portion 102B, and the lock portion 102C are configured to operate by operating one operation handle 88, but the present disclosure is not limited to this configuration. For example, the lock portion 102A, the lock portion 102B, and the lock portion 102C may be operated by plural handles.

In the recovery container 60 of the exemplary embodiment described above, the attachment/detachment handle 100 and the attachment/detachment handle 104 are provided at the container body 62, but the present disclosure is not limited to this configuration, and the attachment/detachment handle 100 and the attachment/detachment handle 104 may not be provided at the container body 62. Also in this case, since the container body 62 is locked to the housing 11 at least at three portions by the lock portion 102A, the lock portion 102B, and the lock portion 102C, the same operation as that of the exemplary embodiment above-described may be obtained.

In the exemplary embodiment described above, the recovery container of the present disclosure is applied to the image forming device 10, but the present disclosure is not limited to this configuration. The recovery container of the present disclosure may be applied to a device that forms an image by a method different from that of the image forming device 10, or is not limited to the image forming device 10, as long as the recovery container is used for recovering a powder. For example, the recovery container of the present disclosure may be used in a device for coating or applying a powder (a powdery foodstuff, an additive, or the like) to food or the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

REFERENCES SIGNS LIST

10 image forming device
11 housing (example of "attachment target")
18 developing device (example of "supply unit")
54A hooked portion
55 first opening

56 second opening
57 third opening
60 recovery container
62 container body
62B side portion (example of "one side wall portion")
62C side portion (example of "other side wall portion")
70 transporting auger (example of "transporting member")
86 connector (example of "shaft coupling")
88 operation handle (example of "operation member")
90 projection (example of "first hook portion")
100 attachment/detachment handle (example of "first grip portion")
102A lock portion (example of "first insertion portion")
102B lock portion (example of "second insertion portion")
102C lock portion (example of "third insertion portion")
104 attachment/detachment handle (example of "first grip portion")
106 projection (example of "second hook portion")
110 restriction portion
111 restriction portion

What is claimed is:

1. A recovery container comprising:

a container body that is attachable to and detachable from an attachment target and capable of accommodating a powder;

a first insertion portion that is provided at the container body, is capable of protruding from one of two wall portions of the container body at opposite sides in a direction intersecting an attachment direction of the container body, and is to be inserted into a first opening provided in a portion of the attachment target facing the one of the two wall portions by movement in a protruding direction of the first insertion portion;

a second insertion portion that is provided at the container body, is capable of protruding from other of the two wall portions to a side opposite to the first insertion portion, and is to be inserted into a second opening provided in a portion of the attachment target facing the other of the two wall portions by movement in a protruding direction of the second insertion portion; and a third insertion portion that is provided at the container body, is capable of protruding from the other of the two wall portions to a side same as the second insertion portion, and is to be inserted into a third opening provided in a portion of the attachment target facing the other of the two wall portions by movement in a protruding direction of the third insertion portion.

2. The recovery container according to claim 1, wherein the container body has a shape in which a length of the container body in a direction orthogonal to the attachment direction and to the direction intersecting the attachment direction is longer than a length of the container body in the attachment direction, and wherein the second insertion portion and the third insertion portion are disposed to be separated from each other in the direction orthogonal to the attachment direction and to the direction intersecting the attachment direction.

3. The recovery container according to claim 2, wherein the first insertion portion, the second insertion portion, and the third insertion portion are disposed so as to be deviated from one another in the direction orthogonal to the attachment direction and to the direction intersecting the attachment direction.

4. The recovery container according to claim 3, wherein the container body is provided with an operation member, and wherein a protruding operation of each of the first insertion portion, the second insertion portion and the third insertion portion is interlocked with an operation of the operation member.

5. The recovery container according to claim 4, further comprising:

a first grip portion that is provided on the one of the two wall portions of the container body and extends from the one of the two wall portions to a side opposite to the attachment direction with a gap between the first grip portion and the one of the two wall portions;

a first hook portion having a protruding shape that is provided on a surface of the first grip portion on a side opposite to the container body side and is to be hooked to a first hooked portion provided on the attachment target;

a second grip portion that is provided on the other of the two wall portions of the container body and extends from the other of the two wall portions to a side opposite to the attachment direction with a gap between the second grip portion and the other of the two wall portions; and a second hook portion having a protruding shape that is provided on a surface of the second grip portion on a side opposite to the container body side and is to be hooked to a second hooked portion provided on the attachment target.

6. The recovery container according to claim 3, further comprising:

a first grip portion that is provided on the one of the two wall portions of the container body and extends from the one of the two wall portions to a side opposite to the attachment direction with a gap between the first grip portion and the one of the two wall portions;

a first hook portion having a protruding shape that is provided on a surface of the first grip portion on a side opposite to the container body side and is to be hooked to a first hooked portion provided on the attachment target;

a second grip portion that is provided on the other of the two wall portions of the container body and extends from the other of the two wall portions to a side opposite to the attachment direction with a gap between the second grip portion and the other of the two wall portions; and a second hook portion having a protruding shape that is provided on a surface of the second grip portion on a side opposite to the container body side and is to be hooked to a second hooked portion provided on the attachment target.

7. The recovery container according to claim 2, wherein the container body is provided with an operation member, and wherein a protruding operation of each of the first insertion portion, the second insertion portion and the third insertion portion is interlocked with an operation of the operation member.

8. The recovery container according to claim 7, further comprising:

a first grip portion that is provided on the one of the two wall portions of the container body and extends from the one of the two wall portions to a side opposite to the attachment direction with a gap between the first grip portion and the one of the two wall portions;

a first hook portion having a protruding shape that is provided on a surface of the first grip portion on a side opposite to the container body side and is to be hooked to a first hooked portion provided on the attachment target;

a second grip portion that is provided on the other of the two wall portions of the container body and extends from the other of the two wall portions to a side opposite to the attachment direction with a gap between the second grip portion and the other of the two wall portions; and a second hook portion having a protruding shape that is provided on a surface of the second grip portion on a side opposite to the container body side and is to be hooked to a second hooked portion provided on the attachment target.

9. The recovery container according to claim 2, further comprising:

a first grip portion that is provided on the one of the two wall portions of the container body and extends from the one of the two wall portions to a side opposite to the attachment direction with a gap between the first grip portion and the one of the two wall portions;

a first hook portion having a protruding shape that is provided on a surface of the first grip portion on a side opposite to the container body side and is to be hooked to a first hooked portion provided on the attachment target;

a second grip portion that is provided on the other of the two wall portions of the container body and extends from the other of the two wall portions to a side opposite to the attachment direction with a gap between the second grip portion and the other of the two wall portions; and a second hook portion having a protruding shape that is provided on a surface of the second grip portion on a side opposite to the container body side and is to be hooked to a second hooked portion provided on the attachment target.

10. The recovery container according to claim 9, wherein the second grip portion has a plate shape, and wherein the second insertion portion in a protruding state penetrates the second grip portion.

11. The recovery container according to claim 1, wherein the container body is provided with an operation member, and wherein a protruding operation of each of the first insertion portion, the second insertion portion and the third insertion portion is interlocked with an operation of the operation member.

12. The recovery container according to claim 11, further comprising:

a first grip portion that is provided on the one of the two wall portions of the container body and extends from the one of the two wall portions to a side opposite to the attachment direction with a gap between the first grip portion and the one of the two wall portions;

a first hook portion having a protruding shape that is provided on a surface of the first grip portion on a side opposite to the container body side and is to be hooked to a first hooked portion provided on the attachment target;

a second grip portion that is provided on the other of the two wall portions of the container body and extends from the other of the two wall portions to a side opposite to the attachment direction with a gap between the second grip portion and the other of the two wall portions; and a second hook portion having a protruding shape that is provided on a surface of the second grip portion on a side opposite to the container body side and is to be hooked to a second hooked portion provided on the attachment target.

13. The recovery container according to claim 1, further comprising:

a first grip portion that is provided on the one of the two wall portions of the container body and extends from the one of the two wall portions to a side opposite to the attachment direction with a gap between the first grip portion and the one of the two wall portions;

a first hook portion having a protruding shape that is provided on a surface of the first grip portion on a side opposite to the container body side and is to be hooked to a first hooked portion provided on the attachment target;

a second grip portion that is provided on the other of the two wall portions of the container body and extends from the other of the two wall portions to a side opposite to the attachment direction with a gap between the second grip portion and the other of the two wall portions; and a second hook portion having a protruding shape that is provided on a surface of the second grip portion on a side opposite to the container body side and is to be hooked to a second hooked portion provided on the attachment target.

14. The recovery container according to claim 13, wherein the second grip portion has a plate shape, and wherein the second insertion portion in a protruding state penetrates the second grip portion.

15. The recovery container according to claim 13, wherein the second insertion portion is provided with a restriction portion that restricts approach of the second grip portion to the other of the two wall portions when the second insertion portion is in a protruding state.

16. The recovery container according to claim 13, wherein a transporting member that transports the powder from a side of the other of the two wall portions to a side of the one of the two wall portions is provided in the container body, and wherein a shaft coupling for driving the transporting member is provided at a side of the other of the two wall portions on a surface of the container body on a side of the attachment direction.

17. The recovery container according to claim 16, wherein the second insertion portion and the shaft coupling overlap each other in a direction orthogonal to the attachment direction and to the direction intersecting the attachment direction as viewed from the attachment direction.

18. The recovery container according to claim 13, wherein the first grip portion has a plate shape, and wherein the first insertion portion in a protruding state penetrates the first grip portion.

19. The recovery container according to claim 13, wherein the first insertion portion is provided with a restriction portion that restricts approach of the first grip portion to the one of the two wall portions when the first insertion portion is in a protruding state.

20. A powder coating device comprising:

a supply unit that supplies a colorant as a powder; and the recovery container according to claim 1 that recovers the colorant discharged from the supply unit.

* * * * *